US006291413B1

(12) United States Patent
Miracle et al.

(10) Patent No.: US 6,291,413 B1
(45) Date of Patent: Sep. 18, 2001

(54) O-SUBSTITUTED N,N-DIACYLHYDROXYLAMINE BLEACH ACTIVATORS AND COMPOSITIONS EMPLOYING THE SAME

(75) Inventors: Gregory Scot Miracle, Hamilton; Robert Richard Dykstra, Fairfield, both of OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 09/554,203

(22) PCT Filed: Nov. 9, 1998

(86) PCT No.: PCT/US98/23767

§ 371 Date: May 10, 2000

§ 102(e) Date: May 10, 2000

(87) PCT Pub. No.: WO99/24537

PCT Pub. Date: May 20, 1999

Related U.S. Application Data

(60) Provisional application No. 60/064,973, filed on Nov. 10, 1997.

(51) Int. Cl.[7] ..... C11D 3/20; C11D 3/26; C11D 3/395

(52) U.S. Cl. ..... 510/313; 8/111; 252/186.38; 560/42; 564/154; 564/155

(58) Field of Search ..... 510/313, 372, 510/376, 499; 252/186.38; 8/111; 560/42; 564/154, 155

(56) References Cited

U.S. PATENT DOCUMENTS

| | | | |
|---|---|---|---|
| 3,730,902 | 5/1973 | Disch et al. | 252/99 |
| 4,179,390 | 12/1979 | Spadini et al. | 252/95 |
| 4,207,199 | 6/1980 | Perner et al. | 252/174.13 |
| 4,221,675 | 9/1980 | Schirmann et al. | 252/186 |
| 4,745,103 | 5/1988 | Oono et al. | 514/23 |
| 4,772,413 | 9/1988 | Massaux et al. | 252/102 |
| 4,851,138 | 7/1989 | Jaroschek et al. | 252/88 |
| 5,106,528 | 4/1992 | Francis et al. | 252/186.23 |
| 5,158,700 | 10/1992 | Sotoya et al. | 252/186.38 |
| 5,220,051 | 6/1993 | Sotoya et al. | 560/142 |
| 5,330,677 | 7/1994 | Sotoya et al. | 252/186.38 |
| 5,438,147 | 8/1995 | Jaekel et al. | 548/210 |
| 5,518,650 | 5/1996 | Jaekel et al. | 252/186.39 |
| 5,610,318 | 3/1997 | Jaekel et al. | 548/479 |

FOREIGN PATENT DOCUMENTS

| | | | |
|---|---|---|---|
| 19704143 | 8/1998 | (DE) | C11D/3/395 |
| 0063017 | 10/1982 | (EP) | C11D/3/395 |
| 0106584 | 4/1984 | (EP) | C11D/3/39 |
| 0163331 | 12/1985 | (EP) | C11D/3/39 |
| 0403152 | 12/1990 | (EP) | C11D/3/39 |
| 0427224 | 5/1991 | (EP) | C07C/229/16 |
| 0512432 | 11/1992 | (EP) | C07D/209/48 |
| 2013139 | 3/1970 | (FR) | C07C/91/00 |
| 08/027487 | 7/1994 | (JP) . | |
| WO 94/18298 | 8/1994 | (WO) | C11D/3/39 |
| WO 98/16610 | 4/1998 | (WO) | C11D/3/00 |
| WO 98/51772 | 11/1998 | (WO) | C11D/3/386 |

*Primary Examiner*—Gregory Delcotto
(74) *Attorney, Agent, or Firm*—Richard S. Echler, Sr.; Steven W. Miller; Kim William Zerby

(57) ABSTRACT

N,N diacyl O-substituted imide bleach activators and compositions employing them are provided. Bleach additive and bleaching compositions including the bleach activators and methods of cleaning fabrics are also provided.

18 Claims, No Drawings

O-SUBSTITUTED N,N-DIACYLHYDROXYLAMINE BLEACH ACTIVATORS AND COMPOSITIONS EMPLOYING THE SAME

This application is a 371 of PCT/US98/23767 Nov. 9, 1998 which claims benefit of 60/064,973 Nov. 10, 1997.

TECHNICAL FIELD

This case relates to O-substituted N,N-diacylhydroxylamine bleach activators, compositions and methods employing the same. In particular, this case relates to bleach additive and bleaching compositions in both liquid and granular form employing O-substituted N,N-diacylhydroxylamine bleach activators. The activators are particularly useful in laundry, automatic dishwashing and hard surface cleaning compositions.

BACKGROUND OF THE INVENTION

The formulation of bleaching compositions which effectively removes a wide variety of soils and stains from fabrics under wide-ranging usage conditions remains a considerable challenge to the laundry detergent industry. Challenges are also faced by the formulator of hard surface cleaning compositions and automatic dishwashing detergent compositions (ADD's), which are expected to efficiently cleanse and sanitize dishware, often under heavy soil loads. The challenges associated with the formulation of truly effective cleaning and bleaching compositions have been increased by legislation which limits the use of effective ingredients such as phosphate builders in many regions of the world.

Oxygen bleaching agents, such as hydrogen peroxide, have become increasingly popular in recent years in household and personal care products to facilitate stain and soil removal. Bleaches are particularly desirable for their stain-removing, dingy fabric cleanup, whitening and sanitization properties. Oxygen bleaching agents have found particular acceptance in laundry products such as detergents, in automatic dishwashing products and in hard surface cleaners. Oxygen bleaching agents, however, are somewhat limited in their effectiveness. Some frequently encountered disadvantages include color damage on fabrics and surfaces. In addition, oxygen bleaching agents tend to be extremely temperature rate dependent. Thus, the colder the solution in which they are employed, the less effective the bleaching action. Temperatures in excess of 60° C. are typically required for effectiveness of an oxygen bleaching agent in solution.

To solve the aforementioned temperature rate dependency, a class of compounds known as "bleach activators" has been developed. Bleach activators, typically perhydrolyzable acyl compounds having a leaving group such as oxybenzenesulfonate, react with the active oxygen group, typically hydrogen peroxide or its anion, to form a more effective peroxyacid oxidant. It is the peroxyacid compound which then oxidizes the stained or soiled substrate material. However, bleach activators are also somewhat temperature dependent. Bleach activators are more effective at warm water temperatures of from about 40° C. to about 60° C. In water temperatures of less than about 40° C., the peroxyacid compound loses some its bleaching effectiveness.

Numerous substances have been disclosed in the art as effective bleach activators. One widely-used bleach activator is tetraacetyl ethylene diamine (TAED). TAED provides effective hydrophilic cleaning especially on beverage stains, but has limited performance on hydrophobic stains, e.g. dingy, yellow stains such as those resulting from body oils. Another type of activator, such as nonanoyloxybenzenesulfonate (NOBS) and other activators which generally comprise long chain alkyl moieties, is hydrophobic in nature and provides excellent performance on dingy stains. However, many of the hydrophobic activators developed demonstrate limited performance on hydrophilic stains.

The search, therefore, continues for more effective activator materials, especially for those which provide satisfactory performance on both hydrophilic and hydrophobic soils and stains. Improved activator materials should be safe, effective, and will preferably be designed to interact with troublesome soils and stains. Various activators have been described in the literature. Many are esoteric and expensive.

It has now been determined that certain selected bleach activators are unexpectedly effective in removing both hydrophilic and hydrophobic soils and stains from fabrics, hard surfaces and dishes. When formulated as described herein, bleach additive and bleaching compositions are provided using the selected bleach activators to remove soils and stains not only from fabrics, but also from dishware in automatic dishwashing compositions, from kitchen and bathroom hard surfaces, and the like, with excellent results.

BACKGROUND ART

Bleach activators of various types are described in U.S. Pat. Nos. 3,730,902; 4,179,390; 4,207,199; 4,221,675; 4,772,413; 5,106,528; European Patent 063,017; European Patent 106,584; European Patent 163,331; Japanese Patent 08/27487 and PCT Publication W.O. 94/18298. Imide Compounds of various types are disclosed in U.S. Pat. Nos. 4,745,103 and 4,851,138.

SUMMARY OF THE INVENTION

The present invention discloses O-substituted N,N-diacylhydroxylamine bleach activators for use in both solid and liquid additive, bleaching and detergent compositions. The O-substituted N,N-diacylhydroxylamine bleach activators of the present invention display the unique ability to form both hydrophilic and hydrophobic bleaching agents in aqueous liquors such as bleaching solutions. Thus, fabrics, hard surfaces or dishes having hydrophobic stains such as dingy and/or hydrophilic stains such as beverages can be effectively cleaned or bleached using the bleach activators of the present invention. Accordingly, the imide bleach activators of the present invention provide a unique and superior capability and benefit over the activators of the prior art.

According to a first embodiment of the present invention, a bleach activator compound is provided. The bleach activator of the present invention is an O-substituted N,N-diacylhydroxylamine having the formula:

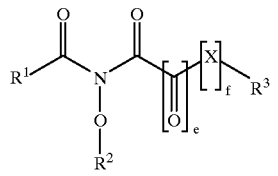

wherein X is selected from O, $NR^{16}$ and S; e is 0 or 1; f is 0 or 1; $R^{16}$ is selected from H and $C_1$–$C_4$ linear or branched, saturated or unsaturated alkyl groups; and (i) $R^1$ may be selected from the group consisting of (a) phenyl, $C_7$–$C_{13}$ linear or branched chain, saturated or unsaturated alkyl, $C_7$–$C_{13}$ linear or branched chain, saturated or unsaturated alkaryl; $C_7$–$C_{13}$ linear or branched chain, saturated or unsaturated aralkyl, (b) a moiety having the formula:

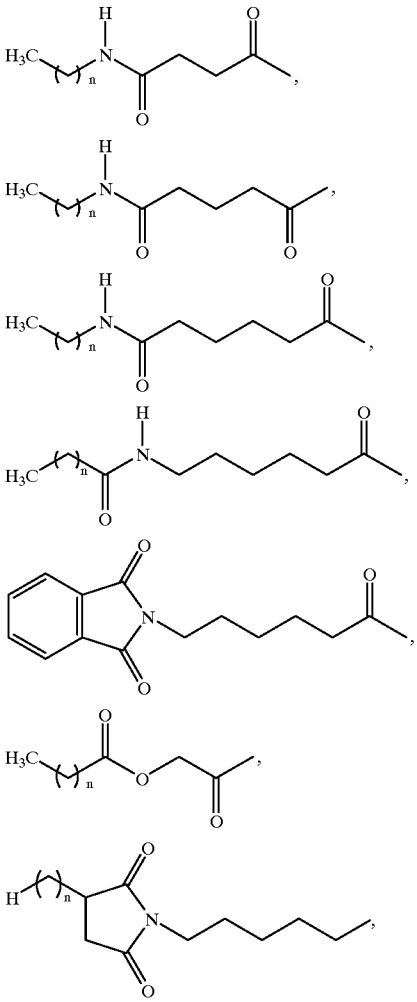

, wherein n is an integer from about 0 to about 12, and (c) a moiety having the formula:

$$(Y^{a-})_{1/a}Q—E—$$

wherein Q has the formula $R^{13}R^{14}R^{15}N^+$ and any of $R^{13}$, $R^{14}$ and $R^{15}$ is independently selected from the group consisting of substituted or unsubstituted alkyl, substituted or unsubstituted alkaryl and substituted or unsubstituted aryl; E is a substituted or unsubstituted polyalkylene, substituted or unsubstituted arylalkylene, substituted or unsubstituted arylpolyalkylene, substituted or unsubstituted polyalkylene-arylalkylene or substituted or unsubstituted polyalkylene-arylpolyalkylene; a is 1 or higher; and $(Y^{a-})_{1/a}$ is a charge-balancing compatible anion;

(ii) $R^2$ is selected from the group consisting of (a) $C_1$–$C_{10}$ branched or unbranched, saturated or unsaturated alkyl, $C_1$–$C_{10}$ branched or unbranched, saturated or unsaturated alkaryl, $C_1$–$C_{10}$ branched or unbranched, saturated or unsaturated aralkyl, and phenyl, (b) $(CH_2)k'CO_2R^8$, where $R^8$ is defined as in (ii)(a) and k' is an integer ranging from about 1 to about 5, (c) $(CH_2)_kN^+R^4R^5R^6$ $(Y^{a-})_{1/a}$, where k is an integer ranging from about 2 to about 6, $R^4$ and $R^5$ are independently selected from the group consisting of substituted or unsubstituted alkyl, substituted or unsubstituted alkaryl and substituted or unsubstituted aryl; $R^6$ is independently selected from H, $R^4$, —$O^-$, $(CH_2)_qSO_3^-$, $(CH_2)_qCO_2^-$ where q is an integer ranging from about 1 to about 5, and $CH_2CHR^7OSO_3^-$ where $R^7$ is a $C_1$–$C_{10}$ branched or unbranched, saturated or unsaturated alkyl, a is an integer having a value of at least one, $(Y^{a-})_{1/a}$ is a charge-balancing compatible anion and further provided that $R^1$ and $R^2$ can not both contain a quaternary nitrogen atom, (d) $(CH_2)_tR^{17}$ $(Z^{g+})_{1/g}$ where t is an integer ranging from about 1 to about 6, $R^{17}$ is selected from $SO_3^-$, $OSO_3^-$, $CO_2^-$, and $OCO_2^-$, g is an integer having a value of at least one, $(Z^{g+})_{1/g}$ is a charge-balancing compatible cation and further provided that $R^2$ can not be $(CH_2)_tR^{17}$ $(Z^{g+})_{1/g}$ if $R^1$ contains a quaternary nitrogen, (e)

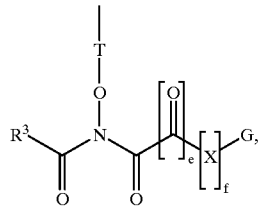

where T is a spacer group selected from the group consisting of $C_2$–$C_{16}$ linear or branched, substituted or unsubstituted alkyl, $C_2$–$C_{16}$ linear or branched, substituted or unsubstituted alkaryl, $C_2$–$C_{16}$ linear or branched, substituted or unsubstituted aralkyl, $C_2$–$C_{16}$ linear or branched, substituted or unsubstituted aryl, and

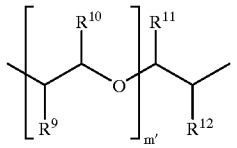

wherein M' is an integer ranging from about 1 to about 10 and each of $R^9$, $R^{10}$, $R^{11}$, and $R^{12}$ are independently selected from H and $CH_3$ and G is $R^1$ or $R^3$ as defined herein; and (iii) $R^3$ is selected from $C_1$–$C_{12}$ linear or branched chain, saturated or unsaturated alkyl, $C_1$–$C_{12}$ linear or branched chain, saturated or unsaturated alkaryl, $C_1$–$C_{12}$ linear or branched chain, saturated or unsaturated aralkyl, $C_1$–$C_{12}$ linear or branched chain, saturated or unsaturated aryl group and wherein when e and f are 0, $R^3$ is selected from $C_2$–$C_{12}$ linear or branched chain, saturated or unsaturated alkyl, $C_2$–$C_{12}$ linear or branched chain, saturated or unsaturated alkaryl, $C_2$–$C_{12}$ linear or branched chain, saturated or unsaturated aralkyl, and $C_2$–$C_{12}$ linear or branched chain, saturated or unsaturated aryl group.

Preferably, $R_1$ is a $C_7$–$C_{13}$ linear or branched chain saturated or unsaturated alkyl group, more preferably a $C_7$–$C_{11}$ linear or branched saturated alkyl group, $R_2$ is a $C_1$–$C_8$, linear or branched chain saturated or unsaturated alkyl group, more preferably a $C_1$–$C_4$ linear saturated alkyl group and $R_3$ is a $C_1$–$C_4$ linear or branched chain saturated or unsaturated alkyl group. Even more preferred is when $R_1$ is a $C_7$–$C_{11}$ saturated alkyl group and most preferably, $R_1$ is a linear $C_8$ or $C_9$ saturated alkyl group and $R_2$ and $R_3$ are $CH_3$. In preferred situations, the sum of the number of carbon atoms in $R_1$, $R_2$ and $R_3$ is less than 19, more preferably less than 15, provided that the bleach activator is not a salt.

According to another embodiment of the present invention, a bleach additive composition is provided. The additive composition comprises the bleach activator as described above when $R^3$ is defined as being selected from $C_1$–$C_{12}$ linear or branched chain, saturated or unsaturated alkyl, $C_1$–$C_{12}$ linear or branched chain, saturated or unsaturated alkaryl, $C_1$–$C_{12}$ linear or branched chain, saturated or unsaturated aralkyl, $C_1$–$C_{12}$ linear or branched chain, saturated or unsaturated aryl group and from about 0.1% to about 99.9% by weight of the composition of conventional additive ingredients.

The preferred R moieties remain the same as described hereinbefore. The conventional additive ingredients may comprise a source of hydrogen peroxide, a surfactant selected from the group consisting of nonionic surfactants, cationic surfactant, anionic surfactants, zwitterionic surfactants, amphoteric surfactants and mixtures thereof, preferably nonionic surfactants and/or be selected from the group consisting of chelating agents, polymeric soil release agents, bleach catalysts, enzymes, builders and mixtures thereof.

According to still another embodiment of the present invention, a method for bleaching soiled fabrics comprising the steps of contacting soiled fabrics to be bleached with an aqueous bleaching liquor, the bleaching liquor including an effective amount of the bleach activator and/or bleaching composition as described above.

Accordingly, it is an object of the present invention to provide an O-substituted N,N-diacylhydroxylamine bleach activator which can provide both hydrophobic and hydrophilic bleaching agents. It is another object of the present invention to provide a bleaching composition, in both solid and liquid forms, containing an O-substituted N,N-diacylhydroxylamine bleach activator and hydrogen peroxide. Lastly, it is an object of the present invention to provide a method for bleaching soiled fabrics using an aqueous liquor containing O-substituted N,N-diacylhydroxylamine bleach activator. These, and other, objects, features and advantages will be clear from the following detailed description and the appended claims.

All percentages, ratios and proportions herein are on a weight basis unless otherwise indicated. All documents cited herein are hereby incorporated by reference. All viscosities are measured at a shear rate of 10 rpm on a Brookfield viscometer.

DETAILED DESCRIPTION OF THE PREFERRED EMBODIMENTS

The present invention relates to O-substituted N,N-diacylhydroxylamine bleach activator and to solid and liquid compositions employing the O-substituted N,N-diacylhydroxylamine bleach activator. The compositions, both solid and liquid, may include additive, bleaching and detergent compositions and are useful in fabric, dish and hard surface cleaning. The O-substituted N,N-diacylhydroxylamine bleach activators of the present invention have the formula:

(I)

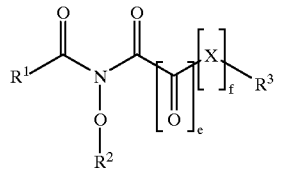

wherein X is selected from O, $NR^{16}$ and S; e is 0 or 1; f is 0 or 1; $R^{16}$ is selected from H and $C_1$–$C_4$ linear or branched, saturated or unsaturated alkyl groups; and (i) $R^1$ may be selected from the group consisting of (a) phenyl, $C_7$–$C_{13}$ linear or branched chain, saturated or unsaturated alkyl, $C_7$–$C_{13}$ linear or branched chain, saturated or unsaturated alkaryl; $C_7$–$C_{13}$ linear or branched chain, saturated or unsaturated aralkyl, (b) a moiety having the formula:

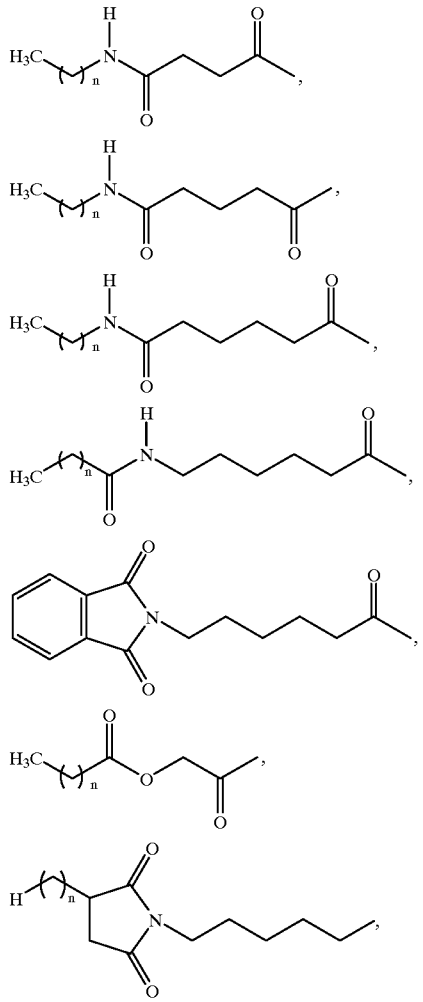

, wherein n is an integer from about 0 to about 12, and (c) a moiety having the formula:

$$(Y^{a-})_{1/a}Q—E—$$

wherein Q has the formula $R^{13}R^{14}R^{15}N^+$ and any of $R^{13}$, $R^{14}$ and $R^{15}$ is independently selected from the group consisting of substituted or unsubstituted alkyl, substituted or unsubstituted alkaryl and substituted or unsubstituted aryl; E is a substituted or unsubstituted polyalkylene, substituted or unsubstituted arylalkylene, substituted or unsubstituted arylpolyalkylene, substituted or unsubstituted polyalkylene-arylalkylene or substituted or unsubstituted polyalkylene-arylpolyalkylene; a is 1 or higher; $(Y^{a-})_{1/a}$ is a charge-balancing compatible anion;

(ii) $R^2$ is selected from the group consisting of (a) $C_1$–$C_{10}$ branched or unbranched, saturated or unsaturated alkyl, $C_1$–$C_{10}$ branched or unbranched, saturated or unsaturated alkaryl, $C_1$–$C_{10}$ branched or unbranched, saturated or unsaturated aralkyl, and phenyl, (b) $(CH_2)k'CO_2R^8$, where $R^8$ is defined as in (ii)(a) and k' is an integer ranging from about 1 to about 5, (c) $(CH_2)_kN^+R^4R^5R^6$ $(Y^{a-})_{1/a}$, where k is an integer ranging from about 2 to about 6, $R^4$ and $R^5$ are independently selected from the group consisting of substituted or unsubstituted alkyl, substituted or unsubstituted alkaryl and substituted or unsubstituted aryl; $R^6$ is independently selected from H, $R^4$, —$O^-$, $(CH_2)_qSO_3^-$, $(CH_2)_qCO_2^-$ where q is an integer ranging from about 1 to about 5, and $CH_2CHR^7OSO_3^-$ where $R^7$ is a $C_1$–$C_{10}$ branched or unbranched, saturated or unsaturated alkyl, a is an integer having a value of at least one, $(Y^{a-})_{1/a}$ is a charge-balancing compatible anion and further provided that $R^1$ and $R^2$ can not both contain a quaternary nitrogen atom, (d) $(CH_2)_tR^{17}$ $(Z^{g+})_{1/g}$ where t is an integer ranging from about 1 to about 6, $R^{17}$ is selected from $SO_3^-$, $OSO_3^-$, $CO_2^-$, and $OCO_2^-$, g is an integer having a value of at least one, $(Z^{g+})_{1/g}$ is a charge-balancing compatible cation and further provided that $R^2$ can not be $(CH_2)_tR^{17}$ $(Z^{g+})_{1/g}$ if $R^1$ contains a quaternary nitrogen, (e)

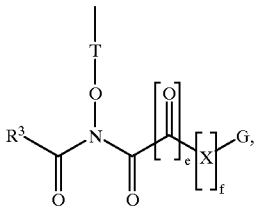

where T is a spacer group selected from the group consisting of $C_2$–$C_{16}$ linear or branched, substituted or unsubstituted alkyl, $C_2$–$C_{16}$ linear or branched, substituted or unsubstituted alkaryl, $C_2$–$C_{16}$ linear or branched, substituted or unsubstituted aralkyl, $C_2$–$C_{16}$ linear or branched, substituted or unsubstituted aryl, and

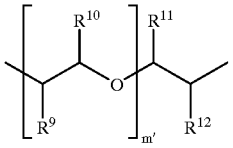

wherein M' is an integer ranging from about 1 to about 10 and each of $R^9$, $R^{10}$, $R^{11}$, and $R^{12}$ are independently selected from H and $CH_3$ and G is $R^1$ or $R^3$ as defined herein; and (iii) $R^3$ is selected from $C_1$–$C_{12}$ linear or branched chain, saturated or unsaturated alkyl, $C_1$–$C_{12}$ linear or branched chain, saturated or unsaturated alkaryl, $C_1$–$C_{12}$ linear or branched chain, saturated or unsaturated aralkyl, $C_1$–$C_{12}$ linear or branched chain, saturated or unsaturated aryl group and wherein when e and f are 0, $R^3$ is selected from $C_2$–$C_{12}$ linear or branched chain, saturated or unsaturated alkyl, $C_2$–$C_{12}$ linear or branched chain, saturated or unsaturated alkaryl, $C_2$–$C_{12}$ linear or branched chain, saturated or unsaturated aralkyl, and $C_2$–$C_{12}$ linear or branched chain, saturated or unsaturated aryl group.

Preferred activators are those in which e and f are 0 and $R_1$ is a $C_7$–$C_{11}$ linear or branched saturated alkyl group, more preferably a $C_7$–$C_{11}$ saturated alkyl group, $R_2$ is a $C_1$–$C_4$ linear or branched saturated alkyl group and $R_3$ is a $C_1$–$C_4$ linear or branched chain saturated or unsaturated alkyl group. Most preferably, e and f are 0 and $R_2$ and $R_3$ are $C_1$–$C_4$ linear saturated alkyl groups and even more preferably are the same.

Further preferred activators according to the present invention are the N-alkanoyl-N-methyl O substituted acetamides. These activators have the formula (I) wherein $R^1$ is a $C_7$–$C_{11}$ linear saturated alkyl group, $R^2$ is a $C_1$–$C_4$ linear saturated alkyl group and $R_3$ is methyl group. Thus, N-alkanoyl-N-methyl O substituted acetamides have the formula:

(II)

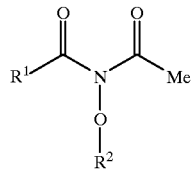

Particularly preferred are N-octanoyl-N-methoxyacetamide (when $R_1$ is $C_7$), N-nonanoyl-N-methoxyacetamide (when $R_1$ is $C_8$), N-decanoyl-N-metboxyacetamide (when $R_1$ is $C_9$) and N-dodecanoyl-N-methoxyacetamide (when $R^1$ is $C_{11}$).

While not wishing to be bound by theory, it is believed that as the number of carbons in the activators of formula (I) increases, the solubility of the compound decreases. Thus, as the activators of the present invention are ideally soluble for optimum performance of the activators, it is preferred that the number of carbon atoms in the activator compound be such that the activator compound displays satisfactory solubility profiles. In the present invention, the sum of the carbons in $R_1$, $R_2$ and $R_3$ is preferably less than 19 and more preferably less than 15, provided that the bleach activator is not a salt.

The O-substituted N,N-diacylhydroxylamine bleach activators of the present invention provide superior bleaching ability and performance over the bleach activators of the prior art. While not wishing to be bound by theory, it is believed that the O-substituted N,N-diacylhydroxylamine bleach activators of the present invention provide both hydrophobic and hydrophilic bleaching agents in aqueous solutions. This is believed to be due to the fact that perhydrolysis can occur at either of the carbonyl groups in the activator. Thus, any molecule of the activators of formula (I) would undergo perhydrolysis in an aqueous solution to form either a bleaching agent ($R_1C(O)OOH$) having hydrophobic properties and a bleaching agent ($R_3C(O)OOH$) having hydrophilic properties when $R_1$ and $R_3$ are defined as above. The bleaching agent may of course be protonated or deprotonated depending upon the in-use pH. A bleaching solution will then include both the hydrophilic bleaching agent and the hydrophobic bleaching agent. Thus, the bleaching capabilities of a mixed activator system (hydrophobic and hydrophilic) and even increased performance can be achieved through the use of a single bleach activator. Elimination of mixed activator systems may provide enormous potential benefits by eliminating the significant expense of an additional bleach activator.

Compositions

Compositions according to the present invention may include liquid, granular and bar compositions in both additive or bleaching composition forms. The compositions are preferably laundry, hard surface cleaning, and automatic dishwashing compositions. Liquid compositions may include those in gel form. Effective bleach compositions herein may comprise the O-substituted N,N-diacylhydroxylamine bleach activator of the present invention as described above generally without a hydrogen peroxide source and thus, be in additive form. Preferably, bleach compositions include detersive surfactants and one or more members selected from the group consisting of low-foaming automatic dishwashing surfactants, nonionic surfactants, bleach stable thickeners, transition-metal chelants, builders, whitening agents (also known as brighteners) and buffering agents. For non-additive bleach compositions according to the present invention, the O-substituted N,N-diacylhydroxylamine bleach activators of the present invention as described above are generally employed in combination with a source of hydrogen peroxide. Levels of bleach activators herein may vary widely, e.g., from about 0.1% to about 90%, by weight of the composition, although lower levels, e.g., from about 0.1% to about 30%, or from about 0.1% to about 20% by weight of the composition are more typically used.

Conventional Additive Ingredients

Source of Hydrogen Peroxide

Compositions according to the present invention may also include a source of hydrogen peroxide. A source of hydrogen peroxide herein is any convenient compound or mixture which under consumer use conditions provides an effective amount of hydrogen peroxide. Levels may vary widely and are typically from about 0.1% to about 70%, more typically from about 0.2% to about 40% and even more typically from about 0.5% to about 25%, by weight of the bleaching compositions herein.

The source of hydrogen peroxide used herein can be any convenient source, including hydrogen peroxide itself For example, perborate, e.g., sodium perborate (any hydrate but preferably the mono- or tetra-hydrate), sodium carbonate peroxyhydrate or equivalent percarbonate salts, sodium pyrophosphate peroxyhydrate, urea peroxyhydrate, or sodium peroxide can be used herein. Mixtures of any convenient hydrogen peroxide source can also be used. A preferred percarbonate bleach comprises dry particles having an average particle size in the range from about 500 micrometers to about 1,000 micrometers, not more than about 10% by weight of said particles being smaller than about 200 micrometers and not more than about 10% by weight of said particles being larger than about 1,250 micrometers. Optionally, the percarbonate can be coated with silicate, borate or water-soluble surfactants. Percarbonate is available from various commercial sources such as FMC, Solvay and Tokai Denka. The source of hydrogen peroxide and unsymmetrical bleach activator are typically at a ratio of from about 1:3 to about 20:1, as expressed on a basis of peroxide:activator in units of moles $H_2O_2$ delivered by the hydrogen peroxide source to moles bleach activator.

Fully-formulated bleach additive and bleaching compositions, particularly those for use in laundry and automatic dishwashing, typically will also comprise other adjunct ingredients to improve or modify performance. Typical, non-limiting examples of such ingredients are disclosed hereinafter for the convenience of the formulator.

Bleach Catalysts

The present invention compositions and methods utilize metal-containing bleach catalysts that are effective for use in ADD compositions. Preferred are manganese and cobalt-containing bleach catalysts.

One type of metal-containing bleach catalyst is a catalyst system comprising a transition metal cation of defined bleach catalytic activity, such as copper, iron, titanium, ruthenium, tungsten, molybdenum, or manganese cations, an auxiliary metal cation having little or no bleach catalytic activity, such as zinc or aluminum cations, and a sequestrate having defined stability constants for the catalytic and auxiliary metal cations, particularly ethylenediaminetetraacetic acid, ethylenediaminetetra (methylenephosphonic acid) and water-soluble salts thereof Such catalysts are disclosed in U.S. Pat. No. 4,430,243.

Other types of bleach catalysts include the manganese-based complexes disclosed in U.S. Pat. No. 5,246,621 and U.S. Pat. No. 5,244,594. Preferred examples of theses catalysts include $Mn^{IV}_2(u\text{-}O)_3$(1,4,7-trimethyl-1,4,7-triazacyclononane)$_2$-$(PF_6)_2$ ("MnTACN"), $Mn^{III}_2(u\text{-}O)_1(u\text{-}OAc)_2$(1,4,7-trimethyl-1,4,7-triazacyclononane)$_2$-$(ClO_4)_2$, $Mn^{IV}_4(u\text{-}O)_6$(1,4,7-triazacyclononane)$_4$-$(ClO_4)_2$, $Mn^{III}Mn^{IV}_4(u\text{-}O)_1(u\text{-}OAc)_2$(1,4,7-trimethyl-1,4,7-triazacyclononane)$_2$-$(ClO_4)_3$, and mixtures thereof. See also European patent application publication no. 549,272. Other ligands suitable for use herein include 1,5,9-trimethyl-1,5,9-triazacyclododecane, 2-methyl-1,4,7-triazacyclononane, 2-methyl-1,4,7-triazacyclononane, and mixtures thereof.

The bleach catalysts useful in automatic dishwashing compositions and concentrated powder detergent compositions may also be selected as appropriate for the present invention. For examples of suitable bleach catalysts see U.S. Pat. No. 4,246,612 and U.S. Pat. No. 5,227,084.

Other bleach catalysts are described, for example, in European patent application, publication no. 408,131 (cobalt complex catalysts), European patent applications, publication nos. 384,503, and 306,089 (metallo-porphyrin catalysts), U.S. Pat. No. 4,728,455 (manganese/multidentate ligand catalyst), U.S. Pat. No. 4,711,748 and European patent application, publication no. 224,952, (absorbed manganese on aluminosilicate catalyst), U.S. Pat. No. 4,601,845 (aluminosilicate support with manganese and zinc or magnesium salt), U.S. Pat. No. 4,626,373 (manganesealigand catalyst), U.S. Pat. No. 4,119,557 (ferric complex catalyst), German Pat. specification 2,054,019 (cobalt chelant catalyst) Canadian 866,191 (transition metal-containing salts), U.S. Pat. No. 4,430,243 (chelants with manganese cations and non-catalytic metal cations), and U.S. Pat. No. 4,728,455 (manganese gluconate catalysts).

Preferred are cobalt catalysts which have the formula:

$$[Co(NH_3)_n(M')_m]Y_y$$

wherein n is an integer from 3 to 5 (preferably 4 or 5; most preferably 5); M' is a labile coordinating moiety, preferably selected from the group consisting of chlorine, bromine, hydroxide, water, and (when m is greater than 1) combinations thereof; m is an integer from 1 to 3 (preferably 1 or 2; most preferably 1); m+n=6; and Y is an appropriately selected counteranion present in a number y, which is an integer from 1 to 3 (preferably 2 to 3; most preferably 2 when Y is a −1 charged anion), to obtain a charge-balanced salt.

The preferred cobalt catalyst of this type useful herein are cobalt pentaamine chloride salts having the formula $[Co(NH_3)_5Cl]Y_y$, and especially $[Co(NH_3)_5Cl]Cl_2$.

More preferred are the present invention compositions which utilize cobalt (III) bleach catalysts having the formula:

$$[Co(NH_3)_n(M)_m(B)_b]T_y$$

wherein cobalt is in the +3 oxidation state; n is 4 or 5 (preferably 5); M is one or more ligands coordinated to the cobalt by one site; m is 0, 1 or 2 (preferably 1); B is a ligand coordinated to the cobalt by two sites; b is 0 or 1 (preferably 0), and when b=0, then m+n=6, and when b=1, then m=0 and n=4; and T is one or more appropriately selected counter-anions present in a number y, where y is an integer to obtain a charge-balanced salt (preferably y is 1 to 3; most preferably 2 when T is a −1 charged anion); and wherein further said catalyst has a base hydrolysis rate constant of less than 0.23 $M^{-1}$ $s^{-1}$ (25° C.).

Preferred T are selected from the group consisting of chloride, iodide, $I_3^-$, formate, nitrate, nitrite, sulfate, sulfite, citrate, acetate, carbonate, bromide, $PF_6^-$, $BF_4^-$, $B(Ph)_4^-$, phosphate, phosphite, silicate, tosylate, methanesulfonate, and combinations thereof Optionally, T can be protonated if more than one anionic group exists in T, e.g., $HPO_4^{2-}$, $HCO_3^-$, $H_2PO_4^-$, etc. Further, T may be selected from the group consisting of non-traditional inorganic anions such as anionic surfactants (e.g., linear alkylbenzene sulfonates (LAS), alkyl sulfates (AS), alkylethoxysulfonates (AES), etc.) and/or anionic polymers (e.g., polyacrylates, polymethacrylates, etc.).

The M moieties include, but are not limited to, for example, $F^-$, $SO_4^{-2}$, $NCS^-$, $SCN^-$, $S_2O_3^{-2}$, $NH_3$, $PO_4^{3-}$, and carboxylates (which preferably are monocarboxylates, but more than one carboxylate may be present in the moiety as long as the binding to the cobalt is by only one carboxylate per moiety, in which case the other carboxylate in the M moiety may be protonated or in its salt form). Optionally, M can be protonated if more than one anionic group exists in M (e.g., $HPO_4^{2-}$, $HCO_3^-$, $H_2PO_4^-$, HOC(O)$CH_2$C(O)O—, etc.) Preferred M moieties are substituted and unsubstituted $C_1$–$C_{30}$ carboxylic acids having the formulas:

RC(O)O— wherein R is preferably selected from the group consisting of hydrogen and $C_1$–$C_{30}$ (preferably $C_1$–$C_{18}$) unsubstituted and substituted alkyl, $C_6$–$C_{30}$ (preferably $C_6$–$C_{18}$) unsubstituted and substituted aryl, and $C_3$–$C_{30}$ (preferably $C_5$–$C_{18}$) unsubstituted and substituted heteroaryl, wherein substituents are selected from the group consisting of —$NR'_3$, —$NR'_4{}^+$, —C(O)OR', —OR', —C(O)$NR'_2$, wherein R' is selected from the group consisting of hydrogen and $C_1$–$C_6$ moieties. Such substituted R therefore include the moieties —$(CH_2)_n$OH and —$(CH_2)_nNR'_4{}^+$, wherein n is an integer from 1 to about 16, preferably from about 2 to about 10, and most preferably from about 2 to about 5.

Most preferred M are carboxylic acids having the formula above wherein R is selected from the group consisting of hydrogen, methyl, ethyl, propyl, straight or branched $C_4$–$C_{12}$ alkyl, and benzyl. Most preferred R is methyl. Preferred carboxylic acid M moieties include formic, benzoic, octanoic, nonanoic, decanoic, dodecanoic, malonic, maleic, succinic, adipic, phthalic, 2-ethylhexanoic, naphthenoic, oleic, palmitic, triflate, tartrate, stearic, butyric, citric, acrylic, aspartic, fumaric, lauric, linoleic, lactic, malic, and especially acetic acid.

The B moieties include carbonate, di- and higher carboxylates (e.g., oxalate, malonate, malic, succinate, maleate), picolinic acid, and alpha and beta amino acids (e.g., glycine, alanine, beta-alanine, phenylalanine).

Cobalt bleach catalysts useful herein are known, being described for example along with their base hydrolysis rates, in M. L. Tobe, "Base Hydrolysis of Transition-Metal Complexes", *Adv. Inorg. Bioinorg. Mech.*, (1983), 2, pages 1–94. For example, Table 1 at page 17, provides the base hydrolysis rates (designated therein as $k_{OH}$) for cobalt pentaamine catalysts complexed with oxalate ($k_{OH}$=2.5×$10^{-4}$ $M^{-1}$ $s^{-1}$ (25° C.)), $NCS^-$ ($k_{OH}$=5.0×$10^{-4}$ $M^{-1}$ $s^{-1}$ (25° C.)), formate ($k_{OH}$=5.8×$10^4$ $M^{-1}$ $s^{-1}$ (25° C.)), and acetate ($k_{OH}$=9.6×$10^{-4}$ $M^{-1}$ $s^{-1}$ (25° C.)). The most preferred cobalt catalyst useful herein are cobalt pentaamine acetate salts having the formula $[Co(NH_3)_5OAc]Ty$, wherein OAc represents an acetate moiety, and especially cobalt pentaamine acetate chloride, $[Co(NH_3)_5OAc]Cl_2$; as well as $[Co(NH_3)_5OAc](OAc)_2$; $[Co(NH_3)_5OAc](PF_6)_2$; $[Co(NH_3)_5OAc](SO_4)$; $[Co(NH_3)_5OAc](BF_4)_2$; and $[Co(NH_3)_5OAc](NO_3)_2$.

Cobalt catalysts according to the present invention made be produced according to the synthetic routes disclosed in U.S. Pat. Nos. 5,559,261, 5,581,005, and 5,597,936, the disclosures of which are herein incorporated by reference.

These catalysts may be coprocessed with adjunct materials so as to reduce the color impact if desired for the aesthetics of the product, or to be included in enzyme-containing particles as exemplified hereinafter, or the compositions may be manufactured to contain catalyst "speckles".

Particularly preferred organic bleach catalysts include quaternary imine compounds such as those disclosed in U.S. Pat. No. 5,576,282. Particularly preferred are the aryliminium zwitterions as fully disclosed in the '282 patent.

As a practical matter, and not by way of limitation, the cleaning compositions and cleaning processes herein can be adjusted to provide on the order of at least one part per hundred million of the active bleach catalyst species in the aqueous washing medium, and will preferably provide from about 0.01 ppm to about 25 ppm, more preferably from about 0.05 ppm to about 10 ppm, and most preferably from about 0.1 ppm to about 5 ppm, of the bleach catalyst species in the wash liquor. In order to obtain such levels in the wash liquor of an automatic dishwashing process, typical automatic dishwashing compositions herein will comprise from about 0.0005% to about 0.2%, more preferably from about 0.004% to about 0.08%, of bleach catalyst by weight of the cleaning compositions.

Conventional Bleach Activators

Compositions of the present invention may also include, in addition to the unsymmetrical acyclic imide bleach activators, a conventional bleach activator. "Conventional bleach activators" herein are any bleach activators which do not respect the above-identified provisions in defining the unsymmetrical acyclic imide bleach activators herein. Numerous conventional bleach activators are known and are optionally included in the instant bleaching compositions. Various nonlimiting examples of such activators are disclosed in U.S. Pat. No. 4,915,854, issued Apr. 10, 1990 to Mao et al, and U.S. Pat. No. 4,412,934. The nonanoyloxybenzene sulfonate (NOBS) and tetraacetyl ethylenediamine (TAED) activators are typical, and mixtures thereof can also be used. See also U.S. Pat. No. 4,634,551 for other typical conventional bleach activators. Known amido-derived bleach activators are those of the formulae: $R^1N(R^5)C(O)R^2C(O)L$ or $R^1C(O)N(R^5)R^2C(O)L$ wherein $R^1$ is an alkyl group containing from about 6 to about 12 carbon atoms, $R^2$ is an alkylene containing from 1 to about 6 carbon atoms, $R^5$ is H or alkyl, aryl, or alkaryl containing from about 1 to about 10 carbon atoms, and L is any suitable leaving group. Further illustration of optional, conventional bleach activators of the above formulae include (6-octanamido-caproyl) oxybenzenesulfonate, (6-nonanamidocaproyl) oxybenzenesulfonate, (6-decanamido-caproyl) oxybenzenesulfonate, and mixtures thereof as described in U.S. Pat. No. 4,634,551. Another class of conventional bleach activators comprises the benzoxazin-type activators disclosed by Hodge et al in U.S. Pat. No. 4,966,723, issued Oct. 30, 1990. Examples of optional lactam activators include octanoyl caprolactam, 3,5,5-trimethylhexanoyl caprolactam, nonanoyl caprolactam, decanoyl caprolactam, undecenoyl caprolactam, octanoyl valerolactam, decanoyl valerolactam, benzoyl caprolactam, nitrobenzoyl caprolactam, undecenoyl valerolactam, nonanoyl valerolactam, 3,5,5-trimethylhexanoyl valerolactam and mixtures thereof Bleaching agents other than hydrogen peroxide sources are also known in the art and can be utilized herein as adjunct ingredients. One type of non-oxygen bleaching agent of particular interest includes photoactivated bleaching agents such as the sulfonated zinc and/or aluminum phthalocyanines. See U.S. Pat. No. 4,033,718, issued Jul. 5, 1977 to Holcombe et al. If used, detergent compositions will typically contain from about 0.025% to about 1.25%, by weight, of such bleaches, especially sulfonated zinc phthalocyanine.

Organic Peroxides, especially Diacyl Peroxides—are extensively illustrated in Kirk Othmer, Encyclopedia of Chemical Technology, Vol. 17, John Wiley and Sons, 1982 at pages 27–90 and especially at pages 63–72, all incorporated herein by reference. Suitable organic peroxides, especially diacyl peroxides, are further illustrated in "Initiators for Polymer Production", Akzo Chemicals Inc., Product Catalog, Bulletin No. 88-57, incorporated by reference. Preferred diacyl peroxides herein whether in pure or formulated form for granule, powder or tablet forms of the bleaching compositions constitute solids at 25° C., e.g., CADET® BPO 78 powder form of dibenzoyl peroxide, from Akzo. Highly preferred organic peroxides, particularly the diacyl peroxides, for such bleaching compositions have melting points above 40° C., preferably above 50° C. Additionally, preferred are the organic peroxides with SADT's (as defined in the foregoing Akzo publication) of 35° C. or higher, more preferably 70° C. or higher. Non-limiting examples of diacyl peroxides useful herein include dibenzoyl peroxide, lauroyl peroxide, and dicumyl peroxide. Dibenzoyl peroxide is preferred. In some instances, diacyl peroxides are available in the trade which contain oily substances such as dioctyl phthalate. In general, particularly for automatic dishwashing applications, it is preferred to use diacyl peroxides which are substantially free from oily phthalates since these can form smears on dishes and glassware.

Ouaternary Substituted Bleach Activators—The present compositions can optionally further comprise conventional, known quaternary substituted bleach activators (QSBA). QSBA's are further illustrated in U.S. Pat. No. 4,539,130, Sep. 3, 1985 and U.S. Pat. No. 4,283,301. British Pat. 1,382,594, published Feb. 5, 1975, discloses a class of QSBA's optionally suitable for use herein. U.S. Pat. No. 4,818,426 issued Apr. 4, 1989 discloses another class of QSBA's. Also see U.S. Pat. No. 5,093,022 issued Mar. 3, 1992 and U.S. Pat. No. 4,904,406, issued Feb. 27, 1990. Additionally, QSBA's are described in EP 552,812 A1 published Jul. 28, 1993, and in EP 540,090 A2, published May 5, 1993. Multi-quaternary bleach activators as disclosed in U.S. Pat. No. 5,460,747 may also be employed.

Preformed Peracids

The activators of the present invention may of course be used in conjunction with a preformed peracid compound selected from the group consisting of percarboxylic acids and salts, percarbonic acids and salts, perimidic acids and salts, peroxymonosulfuric acids and salts, and mixtures thereof. One class of suitable organic peroxycarboxylic acids have the general formula:

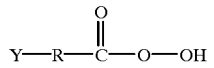

wherein R is an alkylene or substituted alkylene group containing from 1 to about 22 carbon atoms or a phenylene or substituted phenylene group, and Y is hydrogen, halogen, alkyl, aryl, —C(O)OH or —C(O)OOH.

Organic peroxyacids suitable for use in the present invention can contain either one or two peroxy groups and can be either aliphatic or aromatic. When the organic peroxycarboxylic acid is aliphatic, the unsubstituted acid has the general formula:

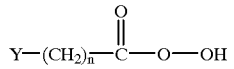

where Y can be, for example, H, $CH_3$, $CH_2Cl$, C(O)OH, or C(O)OOH; and n is an integer from 1 to 20. When the organic peroxycarboxylic acid is aromatic, the unsubstituted acid has the general formula:

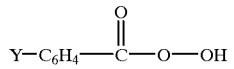

wherein Y can be, for example, hydrogen, alkyl, alkylhalogen, halogen, C(O)OH or C(O)OOH.

Typical monoperoxy acids useful herein include alkyl and aryl peroxyacids such as:

(i) peroxybenzoic acid and ring-substituted peroxybenzoic acid, e.g. peroxy-a-naphthoic acid, monoperoxyphthalic acid (magnesium salt hexahydrate), and o-carboxybenzamidoperoxyhexanoic acid (sodium salt);

(ii) aliphatic, substituted aliphatic and arylalkyl monoperoxy acids, e.g. peroxylauric acid, peroxystearic acid, N-nonanoylaminoperoxycaproic acid (NAPCA), N,N-(3-octylsuccinoyl)aminoperoxycaproic acid (SAPA) and N,N-phthaloylaminoperoxycaproic acid (PAP);

(iii) amidoperoxyacids, e.g. monononylamide of either peroxysuccinic acid (NAPSA) or of peroxyadipic acid (NAPAA).

Typical diperoxyacids useful herein include alkyl diperoxyacids and aryldiperoxyacids, such as:

(iv) 1,12-diperoxydodecanedioic acid;

(v) 1,9-diperoxyazelaic acid;

(vi) diperoxybrassylic acid; diperoxysebacic acid and diperoxyisophthalic acid;

(vii) 2-decyldiperoxybutane-1,4-dioic acid;

(viii) 4,4'-sulfonylbisperoxybenzoic acid.

Detersive Surfactant

The compositions of the present invention may include a detersive surfactant. The detersive surfactant may comprise from about 1%, to about 99.8%, by weight of the composition depending upon the particular surfactants used and the effects desired. More typical levels comprise from about 5% to about 80% by weight of the composition.

The detersive surfactant can be nonionic, anionic, ampholytic, zwitterionic, or cationic. Mixtures of these surfactants can also be used. Preferred detergent compositions comprise anionic detersive surfactants or mixtures of anionic surfactants with other surfactants, especially nonionic surfactants.

Nonlimiting examples of surfactants useful herein include the conventional $C_{11}$–$C_{18}$ alkyl benzene sulfonates and primary, secondary and random alkyl sulfates, the $C_8$–$C_{18}$ alkyl alkoxy sulfates, the $C_8$–$C_{18}$ alkyl polyglycosides and their corresponding sulfated polyglycosides, $C_8$–$C_{18}$ alpha-sulfonated fatty acid esters, $C_8$–$C_{18}$ alkyl and alkyl phenol alkoxylates (especially ethoxylates and mixed ethoxy/propoxy), $C_8$–$C_{18}$ betaines and sulfobetaines ("sultaines"), $C_8$–$C_{18}$ amine oxides, such as branched or unbranched aliphatic N,N-dimethyl-N-oxides and the like. Other conventional useful surfactants are listed in standard texts such as Surfactants in Consumer Products; Theory, Technology and Application, J. Falbe, ed. Springer-Verlag 1987 and Handbook of Surfactants, M. R. Porter, Blackie & Son, 1991.

One class of nonionic surfactant particularly useful in detergent compositions of the present invention is condensates of ethylene oxide with a hydrophobic moiety to provide a surfactant having an average hydrophilic-lipophilic balance (HLB) in the range of from 5 to 17, preferably from 6 to 16, more preferably from 7 to 15. The hydrophobic (lipophilic) moiety may be aliphatic or aromatic in nature. The length of the polyoxyethylene group which is condensed with any particular hydrophobic group can be readily adjusted to yield a water-soluble compound having the desired degree of balance between hydrophilic and hydrophobic elements.

Especially preferred nonionic surfactants of this type are the $C_8$–$C_{15}$ primary alcohol ethoxylates containing 3–12 moles of ethylene oxide per mole of alcohol, particularly the $C_{14}$–$C_{15}$ primary alcohols containing 6–8 moles of ethylene oxide per mole of alcohol, the $C_{12}$–$C_{15}$ primary alcohols containing 3–5 moles of ethylene oxide per mole of alcohol, the $C_9$–$C_{11}$ primary alcohols containing 8–12 moles of ethylene oxide per mole of alcohol, and mixtures thereof. Suitable ethoxylated fatty alcohol nonionic surfactants for use in the present invention are commercially available under the tradenames DOBANOL and NEODOL available from the Shell Oil Company of Houston, Tex.

Another suitable class of nonionic surfactants comprises the polyhydroxy fatty acid amides of the formula:

$$R^2C(O)N(R^1)Z$$

wherein: $R^1$ is H, $C_1$–$C_8$ hydrocarbyl, 2-hydroxyethyl, 2-hydroxypropyl, or a mixture thereof, preferably $C_1$–$C_4$ alkyl, more preferably $C_1$ or $C_2$ alkyl, most preferably $C_1$ alkyl (i.e., methyl); and $R^2$ is a $C_5$–$C_{32}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{19}$ alkyl or alkenyl, or mixture thereof; and Z is a polyhydroxyhydrocarbyl moiety having a linear hydrocarbyl chain with at least 2 (in the case of glyceraldehyde) or at least 3 hydroxyls (in the case of other reducing sugars) directly connected to the chain, or an alkoxylated derivative (preferably ethoxylated or propoxylated) thereof Z preferably will be derived from a reducing sugar in a reductive amination reaction; more preferably Z is a glycityl moiety. Suitable reducing sugars include glucose, fructose, maltose, lactose, galactose, mannose, and xylose, as well as glyceraldehyde. As raw materials, high dextrose corn syrup, high fructose corn syrup, and high maltose corn syrup can be utilized as well as the individual sugars listed above. These corn syrups may yield a mix of sugar components for Z. It should be understood that it is by no means intended to exclude other suitable raw materials. Z preferably will be selected from the group consisting of $—CH_2—(CHOH)n—CH_2OH$, $—CH(CH_2OH)—(CHOH)_{n-}—CH_2OH$, $—CH_2—(CHOH)_2(CHOR')(CHOH)—CH_2OH$, where n is an integer from 1 to 5, inclusive, and R' is H or a cyclic mono- or polysaccharide, and alkoxylated derivatives thereof Most preferred are glycityls wherein n is 4, particularly $—CH_2—(CHOH)_4—CH_2OH$.

In Formula (I), $R^1$ can be, for example, N-methyl, N-ethyl, N-propyl, N-isopropyl, N-butyl, N-isobutyl, N-2-hydroxy ethyl, or N-2-hydroxy propyl. For highest sudsing, $R^1$ is preferably methyl or hydroxyalkyl. If lower sudsing is desired, $R^1$ is preferably $C_2$–$C_8$ alkyl, especially n-propyl, iso-propyl, n-butyl, iso-butyl, pentyl, hexyl and 2-ethyl hexyl.

$R^2—CO—N<$ can be, for example, cocamide, stearamide, oleamide, lauramide, myristamide, capricamide, palmitamide, tallowamide, etc.

Detersive Enzymes

The compositions of the present invention may also include the presence of at least one detersive enzyme. "Detersive enzyme", as used herein, means any enzyme having a cleaning, stain removing or otherwise beneficial effect in a cleaning composition. Preferred detersive enzymes are hydrolases such as proteases, amylases and lipases. Highly preferred for automatic dishwashing are amylases and/or proteases, including both current commercially available types and improved types which, though more bleach compatible, have a remaining degree of bleach deactivation susceptibility.

In general, as noted, preferred compositions herein comprise one or more detersive enzymes. If only one enzyme is used, it is preferably an amyloytic enzyme when the composition is for automatic dishwashing use. Highly preferred for automatic dishwashing is a mixture of proteolytic enzymes and amyloytic enzymes. More generally, the enzymes to be incorporated include proteases, amylases, lipases, cellulases, and peroxidases, as well as mixtures thereof Other types of enzyines may also be included. They may be of any suitable origin, such as vegetable, animal, bacterial, fungal and yeast origin. However, their choice is governed by several factors such as pH-activity and/or stability optima, thermostability, stability versus active detergents, builders, etc. In this respect bacterial or fungal enzymes are preferred, such as bacterial amylases and proteases, and fungal cellulases.

Enzymes are normally incorporated in the instant detergent compositions at levels sufficient to provide a "cleaning-effective amount". The term "cleaning-effective amount" refers to any amount capable of producing a cleaning, stain removal or soil removal effect on substrates such as fabrics, dishware and the like. Since enzymes are catalytic materials, such amounts may be very small. In practical terms for current commercial preparations, typical amounts are up to about 5 mg by weight, more typically about 0.01 mg to about 3 mg, of active enzyme per gram of the composition. Stated otherwise, the compositions herein will typically comprise from about 0.001% to about 6%, preferably 0.01%–1% by weight of a commercial enzyme preparation. Protease enzymes are usually present in such commercial preparations at levels sufficient to provide from 0.005 to 0.1 Anson units (AU) of activity per gram of composition. For automatic dishwashing purposes, it may be desirable to increase the active enzyme content of the commercial preparations, in order to minimize the total amount of non-catalytically active materials delivered and thereby improve spotting/filming results.

Suitable examples of proteases are the subtilisins which are obtained from particular strains of *B. subtilis* and *B. licheniformis*. Another suitable protease is obtained from a strain of Bacillus, having maximum activity throughout the pH range of 8–12, developed and sold by Novo Industries A/S as ESPERASE®. The preparation of this enzyme and analogous enzymes is described in British Patent Specification No. 1,243,784 of Novo. Proteolytic enzymes suitable for removing protein-based stains that are commercially available include those sold under the tradenames ALCALASE® and SAVINASE® by Novo Industries A/S (Denmark) and MAXATASE® by International Bio-Synthetics, Inc. (The Netherlands). Other proteases include Protease A (see European Patent Application 130,756, published Jan. 9, 1985) and Protease B (see European Patent Application Serial No. 87303761.8, filed Apr. 28, 1987, and European Patent Application 130,756, Bott et al, published Jan. 9, 1985).

An especially preferred protease, referred to as "Protease D" is a carbonyl hydrolase variant having an amino acid sequence not found in nature, which is derived from a precursor carbonyl hydrolase by substituting a different amino acid for a plurality of amino acid residues at a position in said carbonyl hydrolase equivalent to position +76, preferably also in combination with one or more amino acid residue positions equivalent to those selected from the group consisting of +99, +101, +103, +104, +107, +123, +27, +105, +109, +126, +128, +135, +156, +166, +195, °197, +204, +206, +210, +216, +217, +218, +222, +260, +265, and/or +274 according to the numbering of *Bacillus amyloliquiefaciens* subtilisin, as described in WO 95/10615 published Apr. 20, 1995 by Genencor International.

Other preferred protease enzymes include protease enzymes which are a carbonyl hydrolase variant having an amino acid sequence not found in nature, which is derived by replacement of a plurality of amino acid residues of a precursor carbonyl hydrolase with different amino acids, wherein said plurality of amino acid residues replaced in the precursor enzyme correspond to position +210 in combination with one or more of the following residues: +33, +62, +67, +76, +100, +101, +103, +104, +107, +128, +129, +130, +132, +135, +156, +158, +164, +166, +167, +170, +209, +215, +217, +218 and +222, where the numbered positions correspond to naturally-occurring subtilisin from *Bacillus amyloliquefaciens* or to equivalent amino acid residues in other carbonyl hydrolases or subtilisins (such as *Bacillus lentus* subtilisin). Preferred enzymes include those having position changes +210, +76, +103, +104, +156, and +166.

Useful proteases are also described in PCT publications: WO 95/30010 published Nov. 9, 1995 by The Procter & Gamble Company; WO 95/30011 published Nov. 9, 1995 by The Procter & Gamble Company; WO 95/29979 published Nov. 9, 1995 by The Procter & Gamble Company.

Amylases suitable herein include, for example, α-amylases described in British Patent Specification No. 1,296,839 (Novo), RAPIDASE®, International Bio-Synthetics, Inc. and TERMAMYL®, Novo Industries.

Preferred amylases herein have the commonalty of being derived using site-directed mutagenesis from one or more of the Baccillus amylases, especially the Bacillus alpha-amylases, regardless of whether one, two or multiple amylase strains are the immediate precursors.

As noted, "oxidative stability-enhanced" amylases are preferred for use herein despite the fact that the invention makes them "optional but preferred" materials rather than essential. Such amylases are non-limitingly illustrated by the following:

(a) An amylase according to the hereinbefore incorporated WO/94/02597, Novo Nordisk A/S, published Feb. 3, 1994, as further illustrated by a mutant in which substitution is made, using alanine or threonine (preferably threonine), of the methionine residue located in position 197 of the *B. licheniformis* alpha-amylase, known as TERMAMYL®, or the homologous position variation of a similar parent amylase, such as *B. amyloliquefaciens, B. subtilis*, or *B. stearothermophilus*;

(b) Stability-enhanced amylases as described by Genencor International in a paper entitled "Oxidatively Resistant alpha-Amylases" presented at the 207th American Chemical Society National Meeting, Mar. 13–17 1994, by C. Mitchinson. Therein it was noted that bleaches in automatic dishwashing detergents inactivate alpha-amylases but that improved oxidative stability amylases have been made by Genencor from *B. licheniformis* NCIB8061. Methionine (Met) was identified as the most likely residue to be modified. Met was substituted, one at a time, in positions 8,15,197,256,304,366 and 438 leading to specific mutants, particularly important being M197L and M197T with the M197T variant being the most stable expressed variant. Stability was measured in CASCADE® and SUNLIGHT®;

(c) Particularly preferred herein are amylase variants having additional modification in the immediate parent available from Novo Nordisk A/S and are those referred to by the supplier as QL37+M197T.

Cellulases usable in, but not preferred, for the present invention include both bacterial or fungal cellulases. Typically, they will have a pH optimum of between 5 and 9.5. Suitable cellulases are disclosed in U.S. Pat. No. 4,435,307, Barbesgoard et al, issued Mar. 6, 1984, which discloses fungal cellulase produced from *Humicola insolens* and Humicola strain DSM1800 or a cellulase 212-producing fungus belonging to the genus Aeromonas, and cellulase extracted from the hepatopancreas of a marine mollusk (Dolabella Auricula Solander). Suitable cellulases are also disclosed in GB-A-2.075.028; GB-A-2.095.275 and DE—OS-2.247.832. CAREZYME® (Novo) is especially useful.

Suitable lipase enzymes for detergent use include those produced by microorganisms of the Pseudomonas group, such as *Pseudomonas stutzeri* ATCC 19.154, as disclosed in British Patent 1,372,034. See also lipases in Japanese Patent Application 53,20487, laid open to public inspection on Feb. 24, 1978. This lipase is available from Amano Pharmaceutical Co. Ltd., Nagoya, Japan, under the trade name Lipase P "Amano," hereinafter referred to as "Amano-P." Other commercial lipases include Amano-CES, lipases ex *Chromobacter viscostim*, e.g. *Chromobacter viscostim* var. lipolyticum NRRLB 3673, commercially available from Toyo Jozo Co., Tagata, Japan; and further *Chromobacter viscoswm* lipases from U.S. Biochemical Corp., U.S.A. and Disoynth Co., The Netherlands, and lipases ex *Pseudomonas gladioli*. The LIPOLASE® enzyme derived from *Humicola lanuginosa* and commercially available from Novo (see also EPO 341,947) is a preferred lipase for use herein. Another preferred lipase enzyme is the D96L variant of the native *Humicola lanuginosa* lipase, as described in WO 92/05249 and Research Disclosure No. 35944, Mar. 10, 1994, both published by Novo. In general, lipolytic enzymes are less preferred than amylases and/or proteases for automatic dishwashing embodiments of the present invention.

Peroxidase enzymes can be used in combination with oxygen sources, e.g., percarbonate, perborate, persulfate, hydrogen peroxide, etc. They are typically used for "solution bleaching," i.e. to prevent transfer of dyes or pigments removed from substrates during wash operations to other substrates in the wash solution. Peroxidase enzymes are known in the art, and include, for example, horseradish peroxidase, ligninase, and haloperoxidase such as chloro- and bromo-peroxidase. Peroxidase-containing detergent compositions are disclosed, for example, in PCT International Application WO 89/099813, published Oct. 19, 1989, by O. Kirk, assigned to Novo Industries A/S. The present invention encompasses peroxidase-free automatic dishwashing composition embodiments.

A wide range of enzyme materials and means for their incorporation into synthetic detergent compositions are also disclosed in U.S. Pat. No. 3,553,139, issued Jan. 5, 1971 to McCarty et al. Enzymes are further disclosed in U.S. Pat. No. 4,101,457, Place et al, issued Jul. 18, 1978, and in U.S. Pat. No. 4,507,219, Hughes, issued Mar. 26, 1985. Enzymes for use in detergents can be stabilized by various techniques. Enzyme stabilization techniques are disclosed and exemplified in U.S. Pat. No. 3,600,319, issued Aug. 17, 1971 to Gedge, et al, and European Patent Application Publication No. 0 199 405, Application No. 86200586.5, published Oct. 29, 1986, Venegas. Enzyme stabilization systems are also described, for example, in U.S. Pat. No. 3,519,570.

Builders

Detergent builders can optionally be included in the compositions herein to assist in controlling mineral hardness. Inorganic as well as organic builders can be used. Builders are typically used in automatic dishwashing and fabric laundering compositions to assist in the removal of particulate soils.

The level of builder can vary widely depending upon the end use of the composition and its desired physical form. When present, the compositions will typically comprise at least about 1% builder. High performance compositions typically comprise from about 10% to about 80%, more typically from about 15% to about 50% by weight, of the detergent builder. Lower or higher levels of builder, however, are not excluded.

Inorganic or P-containing detergent builders include, but are not limited to, the alkali metal, ammonium and alkanolammonium salts of polyphosphates (exemplified by the tripolyphosphates, pyrophosphates, and glassy polymeric metaphosphates), phosphonates, phytic acid, silicates, carbonates (including bicarbonates and sesquicarbonates), sulphates, and aluminosilicates. However, non-phosphate builders are required in some locales. Importantly, the compositions herein function surprisingly well even in the presence of the so-called "weak" builders (as compared with phosphates) such as citrate, or in the so-called "underbuilt" situation that may occur with zeolite or layered silicate builders. See U.S. Pat. No. 4,605,509 for examples of preferred aluminosilicates.

Examples of silicate builders are the alkali metal silicates, particularly those having a $SiO_2$:$Na_2O$ ratio in the range 1.6:1 to 3.2:1 and layered silicates, such as the layered sodium silicates described in U.S. Pat. No. 4,664,839, issued May 12, 1987 to H. P. Rieck. NaSKS-6® is a crystalline layered silicate marketed by Hoechst (commonly abbreviated herein as "SKS-6"). Unlike zeolite builders, the Na SKS-6 silicate builder does not contain aluminum. NaSKS-6 is the δ-$Na_2SiO_5$ morphology form of layered silicate and can be prepared by methods such as those described in German DE-A-3,417,649 and DE-A-3,742,043. SKS-6 is a highly preferred layered silicate for use herein, but other such layered silicates, such as those having the general formula $NaMSi_xO_{2x+1}.yH_2O$ wherein M is sodium or hydrogen, x is a number from 1.9 to 4, preferably 2, and y is a number from 0 to 20, preferably 0 can be used herein. Various other layered silicates from Hoechst include NaSKS-5, NaSKS-7 and NaSKS-11, as the α-, β- and γ-forms. Other silicates may also be useful, such as for example magnesium silicate, which can serve as a crispening agent in granular formulations, as a stabilizing agent for oxygen bleaches, and as a component of suds control systems.

Silicates useful in automatic dishwashing (ADD) applications include granular hydrous 2-ratio silicates such as BRITESIL® H20 from PQ Corp., and the commonly sourced BRITESIL® H24 though liquid grades of various silicates can be used when the ADD composition has liquid form. Within safe limits, sodium metasilicate or sodium hydroxide alone or in combination with other silicates may be used in an ADD context to boost wash pH to a desired level.

Examples of carbonate builders are the alkaline earth and alkali metal carbonates as disclosed in German Patent Application No. 2,321,001 published on Nov. 15, 1973. Various grades and types of sodium carbonate and sodium sesquicarbonate may be used, certain of which are particularly useful as carriers for other ingredients, especially detersive surfactants.

Aluminosilicate builders are useful in the present invention. Aluminosilicate builders are of great importance in most currently marketed heavy duty granular detergent compositions, and can also be a significant builder ingredient in liquid detergent formulations. Aluminosilicate builders include those having the empirical formula: $[M_z(zAlO_2)_y].xH_2O$ wherein z and y are integers of at least 6, the molar ratio of z to y is in the range from 1.0 to about 0.5, and x is an integer from about 15 to about 264.

Useful aluminosilicate ion exchange materials are commercially available. These aluminosilicates can be crystalline or amorphous in structure and can be naturally-occurring aluminosilicates or synthetically derived. A method for producing aluminosilicate ion exchange materials is disclosed in U.S. Pat. No. 3,985,669, Krummel, et al, issued Oct. 12, 1976. Preferred synthetic crystalline aluminosilicate ion exchange materials useful herein are available under the designations Zeolite A, Zeolite P (B), Zeolite MAP and Zeolite X. In an especially preferred embodiment, the crystalline aluminosilicate ion exchange material has the formula: $Na_{12}[(AlO_2)_{12}(SiO_2)_{12}].xH_2O$ wherein x is from about 20 to about 30, especially about 27. This material is known as Zeolite A. Dehydrated zeolites (x=0–10) may also be used herein. Preferably, the aluminosilicate has a particle size of about 0.1–10 microns in diameter. As with other builders such as carbonates, it may be desirable to use zeolites in any physical or morphological form adapted to promote surfactant carrier function, and appropriate particle sizes may be freely selected by the formulator.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt or "overbased". When utilized in salt form, alkali metals, such as sodium, potassium, and lithium, or alkanolammonium salts are preferred.

Included among the polycarboxylate builders are a variety of categories of useful materials. One important category of polycarboxylate builders encompasses the ether polycarboxylates, including oxydisuccinate, as disclosed in Berg, U.S. Pat. No. 3,128,287, issued Apr. 7, 1964, and Lamberti et al, U.S. Pat. No. 3,635,830, issued Jan. 18, 1972. See also "TMS/TDS" builders of U.S. Pat. No. 4,663,071, issued to Bush et al, on May 5, 1987. Suitable ether polycarboxylates also include cyclic compounds, particularly alicyclic compounds, such as those described in U.S. Pat. Nos. 3,923,679; 3,835,163; 4,158,635; 4,120,874 and 4,102,903.

Other useful detergency builders include the ether hydroxypolycarboxylates, copolymers of maleic anhydride with ethylene or vinyl methyl ether, 1,3,5-trihydroxy benzene-2, 4,6-trisulphonic acid, and carboxymethyloxysuccinic acid, the various alkali metal, ammonium and substituted ammonium salts of polyacetic acids such as ethylenediaminetetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof Citrate builders, e.g., citric acid and soluble salts thereof (particularly sodium salt), are polycarboxylate builders of particular importance for heavy duty laundry detergent formulations due to their availability from renewable resources and their biodegradability. Citrates can also be used in combination with zeolite and/or layered silicate builders. Oxydisuccinates are also especially useful in such compositions and combinations.

Also suitable in the detergent compositions of the present invention are the 3,3-dicarboxy-4-oxa-1,6-hexanedioates and the related compounds disclosed in U.S. Pat. No. 4,566,984, Bush, issued Jan. 28, 1986. Useful succinic acid builders include the $C_5$–$C_{20}$ alkyl and alkenyl succinic acids and salts thereof A particularly preferred compound of this type is dodecenylsuccinic acid. Specific examples of succinate builders include: laurylsuccinate, myristylsuccinate, palmitylsuccinate, 2-dodecenylsuccinate (preferred), 2-pentadecenylsuccinate, and the like. Laurylsuccinates are the preferred builders of this group, and are described in European Patent Application 86200690.5/0,200,263, published Nov. 5, 1986.

Other suitable polycarboxylates are disclosed in U.S. Pat. No. 4,144,226, Crutchfield et al, issued Mar. 13, 1979 and in U.S. Pat. No. 3,308,067, Diehl, issued Mar. 7, 1967. See also U.S. Pat. No. 3,723,322.

Fatty acids, e.g., $C_{12}$–$C_{18}$ monocarboxylic acids, can also be incorporated into the compositions alone, or in combination with the aforesaid builders, especially citrate and/or the succinate builders, to provide additional builder activity. Such use of fatty acids will generally result in a diminution of sudsing, which should be taken into account by the formulator.

In situations where phosphorus-based builders can be used, and especially in the formulation of bars used for hand-laundering operations, the various alkali metal phosphates such as the well-known sodium tripolyphosphates, sodium pyrophosphate and sodium orthophosphate can be used. Phosphonate builders such as ethane-1-hydroxy-1,1-diphosphonate and other known phosphonates (see, for example, U.S. Pat. Nos. 3,159,581; 3,213,030; 3,422,021; 3,400,148 and 3,422,137) can also be used. However, in general, phosphorous-based builders are not desired.

Other Ingredients

Usual ingredients can include one or more materials for assisting or enhancing cleaning performance, treatment of the substrate to be cleaned, or to modify the aesthetics of the composition. Usual detersive adjuncts of detergent compositions include the ingredients set forth in U.S. Pat. No. 3,936,537, Baskerville et al. Adjuncts which can also be included in the compositions employed in the present invention, in their conventional art-established levels for use (generally from 0% to about 20% of the detergent ingredients, preferably from about 0.5% to about 10%), include other active ingredients such as enzyme stabilizers, color speckles, anti-tarnish and/or anti-corrosion agents, dyes, fillers, optical brighteners, germicides, alkalinity sources, hydrotropes, anti-oxidants, enzyme stabilizing agents, perfumes, dyes, solubilizing agents, clay soil removal/anti-redeposition agents, carriers, processing aids, pigments, solvents for liquid formulations, fabric softeners, static control agents, solid fillers for bar compositions, etc. Dye transfer inhibiting agents, including polyamine N-oxides such as polyvinylpyridine N-oxide can be used. Dye-transfer-inhibiting agents are further illustrated by polyvinylpyrrolidone and copolymers of N-vinyl imidazole and N-vinyl pyrrolidone. If high sudsing is desired, suds boosters such as the $C_{10}$–$C_{16}$ alkanolamides can be incorporated into the compositions, typically at 1%–10% levels. The $C_{10}$–$C_{14}$ monoethanol and diethanol amides illustrate a typical class of such suds boosters. Use of such suds boosters with high sudsing adjunct surfactants such as the amine oxides, betaines and sultaines noted above is also advantageous. If desired, soluble magnesium salts such as $MgCl_2$, $MgSO_4$, and the like, can be added at levels of, typically, 0. 1%–2%, to provide additional suds and to enhance grease removal performance.

Bar Compositions

The bleaching and bleach additive compositions of the present invention may also be employed in laundry or cleaning bar forms. Bar forms typically include a surfactant which may include both soap and synthetic detergent or be all synthetic in terms of the surfactant content, in conjunction with a suitable source of hydrogen peroxide and the imide bleach activators of the present invention. Of course one of ordinary skill in the art will recognize that the levels of surfactant, peroxide source and imide activator may vary widely. One such bar composition according to the present invention comprises from about 10% to about 90% surfactant (including soap or mixtures thereof with conventional synthetic surfactants, from about 0.1% to about 40% sodium perborate as peroxide source, from about 0.1% to about 20% imide activator of formula (I), from about 0.1% to about 50% builder, and optionally from about 0.1% to about 60% of organic or inorganic fillers such as talc, starch or the like. Suitable bar compositions and the methods of manufacture are disclosed in U.S. Pat. Nos. 4,151,105, 3,248,333, 5,340,492 and 5,496,488, the disclosures of which are herein incorporated by reference, and in Great Britain Application 2,096,163A.

Hard Surface Cleaning Compositions

The bleaching and bleach additive compositions of the present invention may also take the form of hard surface cleaning compositions. Hard surface cleaning compositions can in general be formulated identically with the bleach or bleach additive compositions described hereinabove, or may be formulated according to the more specialized art of hard surface cleaning, using for example, low-residue surfactants. As with other embodiments of the invention, the pH of such compositions may vary widely, depending upon the intended use of the composition. Suitable hard surface cleaning compositions useful in conjunction with the imide activator of the present invention are described in U.S. Pat. Nos.

5,536,450; 5,536,451; and 5,538,664 the disclosures of which are herein incorporated by reference. Of course, one of ordinary skill in the art will recognize that it is preferable to employ bleach-stable ingredients whenever formulating a source of hydrogen peroxide into the compositions.

Granular Compositions

The bleaching and bleach additive compositions of the present invention can be used in both low density (below 550 grams/liter) and high density granular compositions in which the density of the granule is at least 550 grams/liter. Granular compositions are typically designed to provide an in the wash pH of from about 7.5 to about 11.5, more preferably from about 9.5 to about 10.5. Low density compositions can be prepared by standard spray-drying processes. Various means and equipment are available to prepare high density compositions and are well-known in the art. Current commercial practice in the field employs spray-drying towers to manufacture compositions which have a density less than about 500 g/l. Accordingly, if spray-drying is used as part of the overall process, the resulting spray-dried particles must be further densified using the means and equipment described hereinafter. In the alternative, the formulator can eliminate spray-drying by using mixing, densifying and granulating equipment that is commercially available. See for example Capeci et al, U.S. Pat. No. 5,516,448, issued May 14, 1996 and Capeci et al, U.S. Pat. No. 5,489,392, issued Feb. 6, 1996. Other suitable processes which do not call for the use of spray-drying towers are described by Bollier et al, U.S. Pat. No. 4,828,721, issued May 9, 1989; Beerse et al, U.S. Pat. No. 5,108,646, issued Apr. 28, 1992; and, Jolicoeur, U.S. Pat. No. 5,178,798, issued Jan. 12, 1993.

The bleaching compositions of the present invention are ideally suited for use in laundry applications and automatic dishwashing compositions. Bleach additive compositions are intended to be employed in conjunction with a source of hydrogen peroxide such as a bleaching composition or a bleaching composition including a detergent, e.g. TIDE® WITH BLEACH. Accordingly, the present invention includes a method for laundering a soiled fabric. The method includes contacting a fabric to be laundered with an aqueous laundry liquor. The fabric may comprise most any fabric capable of being laundered in normal consumer use conditions. The laundry liquor includes the added bleach additive or bleaching composition containing a unsymmetrical acyclic imide activator as fully described above. The laundry liquor may also include any of the above described additives to the compositions such as hydrogen peroxide source, detersive surfactants, chelates, and detersive enzymes. The compositions are preferably employed at concentrations of at least about 50 ppm and typically from about 1,000 to about 10,000 ppm in solution. The water temperatures preferably range from about 25° C. to about 50° C. The water to fabric ratio is preferably from about 1:1 to about 15:1.

Methods for washing soiled dishes such as tableware, also involve contacting the soiled dishes with an aqueous dishwashing liquor. The dishwashing liquor includes the added bleach additive or bleaching composition containing an unsymmetrical acyclic imide activator as fully described above. The dishwashing liquor may also include any of the above described additives to the compositions such as hydrogen peroxide source, detersive surfactants, chelates, and detersive enzymes. The compositions are preferably employed at concentrations of at least about 50 ppm and typically from about 1,000 to about 10,000 ppm in solution. The water temperatures preferably range from about 25° C. to about 50° C.

The present invention will now be described by reference to the following examples. Of course, one of ordinary skill in the art will recognize that the present invention is not limited to the specific examples herein described or the ingredients and steps contained therein, but rather, may be practiced according to the broader aspects of the disclosure.

EXAMPLE I

Preparation of N-Methoxy-N-nonanoyl Acetamide (2)

Synthesis of N-Methoxynonanamide (1):

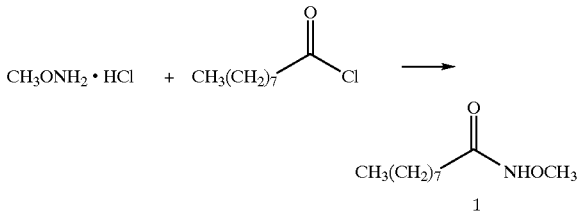

A 100 mL three-neck round-bottom flask equipped with a mechanical stirrer, argon inlet and pressure equalizing addition funnel is charged with ethylacetate (40 mL) and 1 M aqueous solution of potassium carbonate (20 mL, 2 eq). The reaction mixture is cooled in a salt water/ ice bath. Methoxyamine hydrochloride (5.06 g, 1 eq) is added to the reaction mixture followed by a dropwise addition of nonanoyl chloride (10.58 g, 1 eq). The reaction stirs at room temperature overnight. The reaction is diluted with ethylacetate and separated from the aqueous. The organic layer is washed with deionized water (1×50 mL), dried over sodium sulfate, filtered, and concentrated under vacuum.

Synthesis of N-Methoxy-N-nonanoyl acetamide (2):

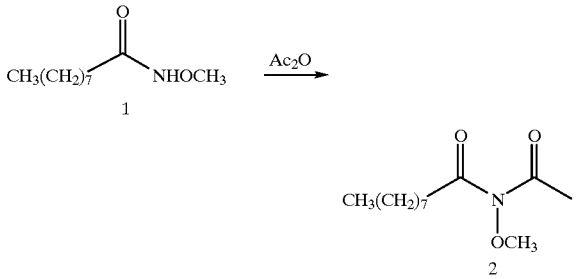

A 100 mL round-bottom flask equipped with a magnetic stir bar, argon inlet and pressure equalizing addition funnel is charged with methylene chloride (22.5 mL), triethylamine (3.80 g, 2 eq) and N-methoxynonanamide (3.5 g, 1 eq). The reaction mixture is stirred and cooled in an ice bath. Acetic anhydride (2.88 g, 1.5 eq) is then added dropwise. The reaction slowly warms to room temperature overnight. The reaction mixture is diluted with methylene chloride (50 mL) and washed with 0.05 M hydrochloric acid solution 1×50 ml), saturated aqueous sodium bicarbonate solution (3×50 mL) and brine 1×50 miL). The organic layer is dried over sodium sulfate, filtered and concentrated under vacuum.

EXAMPLE II

Preparation of N-Methoxy-N-Methoxycarbonyl Nonanamide (3)

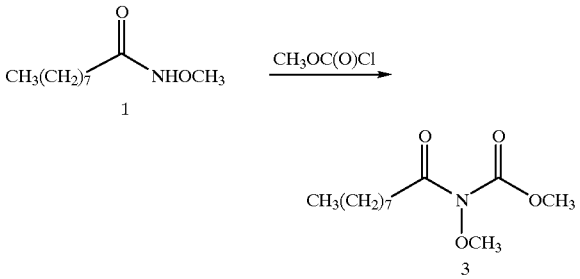

A 100 mL round-bottom flask equipped with a magnetic stir bar, argon inlet and pressure equalizing addition funnel is charged with tetrahydrofuran (14.0 mL), triethylamine (2.13 g, 1.5 eq) and N-methoxynonanamide (1.96 g, 1 eq). The reaction is cooled in an ice bath and methyl chloroformate (1.88 g, 1.4 eq) is added dropwise. The reaction is allowed to warm to room temperature overnight. The tetrahydrofuran is removed under vacuum and the residue is diluted with methylene chloride (25 mL). The reaction is washed with 0.1 M hydrochloric acid solution 1×20 mL), saturated aqueous sodium bicarbonate (3×20 mL)and brine 1×20 mL). The organic layer is dried over sodium sulfate, filtered and concentrated under vacuum.

EXAMPLE III

Preparation of N-Methoxy-N-nonanoyl Pivalamide

The procedure is the same as in EXAMPLE I except that pivalic anhydride is substituted for acetic anhydride in the acylation of N-methoxynonanamide.

EXAMPLE IV

Preparation of N-Methoxy-N-octanoyl Acetamide

The procedure is the same as in EXAMPLE I except that octanoyl chloride is substituted for nonanoyl chloride.

EXAMPLE V

Preparation of N-Methoxy-N-methoxycarbonyl Octanamide

The procedure is the same as in EXAMPLE II except that N-methoxyoctanamide, as prepared in EXAMPLE IV, is substituted for N-methoxynonanamide.

EXAMPLE VI

Preparation of N-Benzyloxy-N-nonanoyl Acetamide

The procedure is the same as in EXAMPLE I except that benzyloxyamine hydrochloride is substituted for methoxyamine hydrochloride.

EXAMPLE VII

Preparation of N-Allyloxy-N-decanoyl Acetamide

The procedure is the same as in EXAMPLE I except that O-alkylhydroxylamine hydrochloride hydrate is substituted for methoxyamine hydrochloride and that decanoyl chloride is substituted for nonanoyl chloride in the preparation of N-alkyloxydecanamide.

EXAMPLE VIII

Bleaching compositions having the form of granular laundry detergents are exemplified by the following formulations.

| INGREDIENT | A % | B % | C % | D % | E % |
|---|---|---|---|---|---|
| Bleach Activator* | 5 | 3.5 | 1 | 3.5 | 2 |
| Sodium Percarbonate | 0 | 0 | 19 | 21 | 0 |
| Sodium Perborate monohydrate | 21 | 21 | 0 | 0 | 20 |
| Conventional Bleach Activator | 0 | 0 | 3 | 1 | 0 |
| Linear alkylbenzenesulfonate | 5.5 | 11 | 19 | 12 | 9.5 |
| Alkyl ethoxylate (C45E7) | 4 | 0 | 3 | 4 | 6 |
| Zeolite A | 20 | 20 | 95 | 17 | 21 |
| SKS-6 ® silicate (Hoechst) | 0 | 0 | 11 | 11 | 0 |
| Trisodium citrate | 5 | 5 | 2 | 3 | 3 |
| Acrylic Acid/Maleic Acid copolymer | 4 | 0 | 4 | 5 | 0 |
| Sodium polyacrylate | 0 | 3 | 0 | 0 | 3 |
| Chelant | 0.4 | 0 | 0.4 | 0 | 0 |
| Carboxymethylcellulose | 0.3 | 0 | 0 | 0.4 | 0 |
| Enzyme | 1.4 | 0.3 | 1.5 | 2.4 | 0.3 |
| Anionic soil release polymer | 0.3 | 0 | 0 | 0.4 | 0.5 |
| Dye transfer inhibiting polymer | 0 | 0 | 0.3 | 0.2 | 0 |
| Carbonate | 16 | 14 | 24 | 6 | 23 |
| Silicate | 3.0 | 0.6 | 12.5 | 0 | 0.6 |
| Sulfate, Water, Perfume, Colorants | to 100 | to 100 | to 100 | to 100 | to 100 |

*Bleach activator according to any of Examples I–VII

EXAMPLE IX

This Example illustrates bleaching compositions, more particularly, liquid bleach additive compositions in accordance with the invention.

| Ingredients | A wt % | B wt % | C wt % | D wt % |
|---|---|---|---|---|
| NEODOL 91-10[1] | 6 | 11.1 | 7 | 4 |
| NEODOL 45-7[1] | 6 | 3.9 | 5 | 8 |
| NEODOL 23-2[1] | 3 | 0 | 3 | 3 |
| DTPA | .10 | .10 | .10 | .10 |
| Bleach Activator[2] | 3.5 | 3.5 | 2 | 7 |
| Citric Acid | 0.5 | 0 | 0 | 0.5 |
| NaOH | to pH 4 | to pH 4 | to pH 4 | to pH 4 |
| Hydrogen Peroxide | 6 | 0 | 0 | 7 |
| Water | Balance to 100% | Balance to 100% | Balance to 100% | Balance to 100% |

[1]Alkyl ethoxylate available from The Shell Oil Company.
[2]Bleach Activator according to any of Examples I–VII.

The compositions are used as bleach boosting additive (to be used in ADDITION to a bleach OR non-bleach detergent such as TIDE®) in a wash test otherwise similar to that used in Example V. The additive is used at 1000 ppm, and the commercial detergent is used at 1000 ppm.

EXAMPLE X

A granular automatic dishwashing detergent composition comprises the following.

| INGREDIENT | A wt % | B wt % | C wt % | D wt % |
|---|---|---|---|---|
| Bleach Activator (See Note 1) | 3.5 | 3.5 | 2 | 6.5 |
| Sodium Perborate Monohydrate (See Note 2) | 1.5 | 0 | 1.5 | 0 |
| Sodium Percarbonate (See Note 2) | 0 | 1.2 | 0 | 1.2 |
| Amylase (TERMAMYL ® from NOVO) | 1.5 | 2 | 2 | 2 |
| Transition Metal Bleach Catalyst (See Note 3) | 0 | 0.1 | 0.1 | 0 |
| Protease (SAVINASE ® 12 T, NOVO, 3.6% active protein) | 2.5 | 2.5 | 2.5 | 2.5 |
| Sodium Bicarbonate | 15 | 0 | 0 | 0 |
| Sodium Carbonate, anhydrous | 20 | 20 | 20 | 20 |
| Nonionic Surfactant (LF404, BASF) | 2.5 | 1.5 | 1.5 | 1.5 |
| Sodium Sulfate, water, minors BALANCE TO: | 100% | 100% | 100% | 100% |

Note 1: Bleach Activator according to any of Examples I–VII.
Note 2: These hydrogen peroxide sources are expressed on a weight % available oxygen basis. To convert to a basis of percentage of the total composition, divide by about 0.15.
Note 3: Transition Metal Bleach Catalyst: Pentaamineacetatocobalt (III) nitrate; may be replaced by MnTACN.

EXAMPLE XI

Cleaning compositions having liquid form especially useful for cleaning bathtubs and shower tiles without being harsh on the hands are as follows:

| Ingredient | % (wt %) A | % (wt %) B |
|---|---|---|
| Bleach Activator* | 7.0 | 5.0 |
| Hydrogen Peroxide | 0.0 | 10.0 |
| $C_{12}$AS, acid form, partially neutralized | 5.0 | 5.0 |
| $C_{12-14}AE_3S$, acid form, partially neutralized | 1.5 | 1.5 |
| $C_{12}$ Dimethyl Amine N-Oxide | 1.0 | 1.0 |
| DEQUEST 2060 | 0.5 | 0.5 |
| Citric acid | 5.5 | 6.0 |
| Abrasive (15–25 micrometer) | 15.0 | 0 |

-continued

| Ingredient | % (wt %) A | % (wt %) B |
|---|---|---|
| HCL | to pH 4 | |
| Filler and water | Balance to 100% | |

*Bleach Activator according to any of Examples I–VII.

EXAMPLE XII

A laundry bar suitable for hand-washing soiled fabrics is prepared by standard extrusion processes and comprises the following:

| Component | Weight % |
|---|---|
| Bleach Activator* | 4 |
| Sodium Perborate Tetrahydrate | 12 |
| $C_{12}$ linear alkyl benzene sulfonate | 30 |
| Phosphate (as sodium tripolyphosphate) | 10 |
| Sodium carbonate | 5 |
| Sodium pyrophosphate | 7 |
| Coconut monoethanolamide | 2 |
| Zeolite A (0.1–10 micron) | 5 |
| Carboxymethylcellulose | 0.2 |
| Polyacrylate (m.w. 1400) | 0.2 |
| Brightener, perfume | 0.2 |
| Protease | 0.3 |
| $CaSO_4$ | 1 |
| $MgSO_4$ | 1 |
| Water | 4 |
| Filler** | Balance to 100% |

*Bleach activator according to any of Examples I–VII.
**Can be selected from convenient materials such as $CaCO_3$, talc, clay, silicates, and the like. Acidic fillers can be used to reduce pH. Fabrics are washed with the bar with excellent results.

What is claimed is:

1. A bleach activator compound comprising:

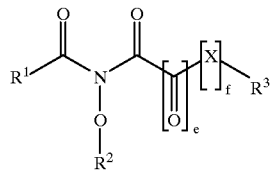

wherein X is selected from O, $NR^{16}$ and S; e is 1; f is 1; $R^{16}$ is selected from H and $C_1$–$C_4$ linear or branched, saturated or unsaturated alkyl groups; and (i) $R^1$ may be selected from the group consisting of (a) phenyl, $C_7$–$C_{13}$ linear or branched chain, saturated or unsaturated alkyl, $C_7$–$C_{13}$ linear or branched chain, saturated or unsaturated alkaryl; $C_7$–$C_{13}$ linear or branched chain, saturated or unsaturated aralkyl, (b) a moiety having the formula:

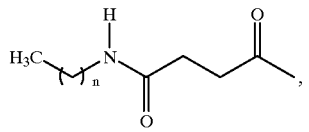

-continued

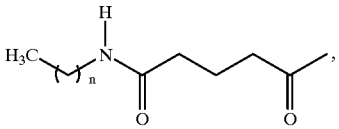

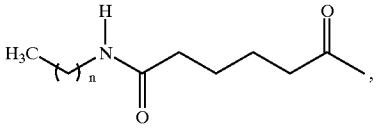

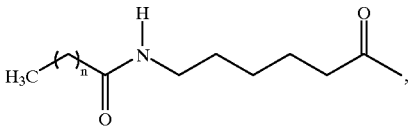

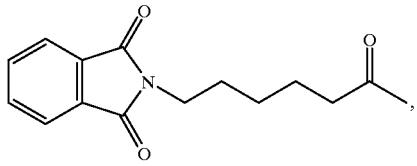

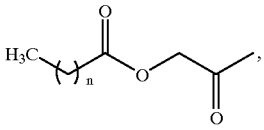

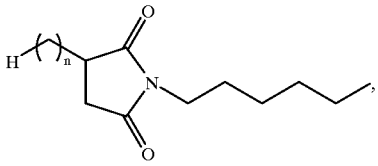

, wherein n is an integer from 0 to 12, and (c) a moiety having the formula:

$(Y^{a-})_{1/a}Q—E—$ wherein Q has the formula $R^{13}R^{14}R^{15}N^+$ and any of $R^{13}$, $R^{14}$ and $R^{15}$ is independently selected from the group consisting of substituted or unsubstituted alkyl, substituted or unsubstituted alkaryl and substituted or unsubstituted aryl; E is a substituted or unsubstituted polyalkylene, substituted or unsubstituted arylalkylene, substituted or unsubstituted arylpolyalkylene, substituted or unsubstituted polyalkylene-arylalkylene or substituted or unsubstituted polyalkylene-arylpolya:kylene; a is 1 or higher; $(Y^{a-})_{1/a}$ is a charge-balancing compatible anion;

(ii) $R^2$ is selected from the group consisting of (a) $C_1$–$C_{10}$ branched or unbranched, saturated or unsaturated alkyl, $C_1$–$C_{10}$ branched or unbranched, saturated or unsaturated alkaryl, $C_1$–$C_{10}$ branched or unbranched, saturated or unsaturated aralkyl, and phenyl, (b) $(CH_2)k'CO_2R^8$, where $R^8$ is defined as in (ii)(a) and k' is an integer ranging from 1 to 5, (c) $(CH_2)_kN^+R^4R^5R^6$ $(Y^{a-})_{1/a}$, where k is an integer ranging from 2 to 6, $R^4$ and $R^5$ are independently selected from the group consisting of substituted or unsubstituted alkyl, substituted or unsubstituted alkaryl and substituted or unsubstituted aryl; $R^6$ is independently selected from H, $R^4$, $—O^-$, $(CH_2)_qSO_3^-$, $(CH_2)_qCO_2^-$ where q is an integer ranging from 1 to 5, and $CH_2CHR^7OSO_3^-$ where $R^7$ is a $C_1$–$C_{10}$ branched or unbranched, saturated or unsaturated alkyl, a is an integer having a value of at least one, $(Y^{a-})_{1/a}$ is a charge-balancing compatible anion and further provided that $R^1$ and $R^2$ can not both contain a quaternary nitrogen atom, (d) $(CH_2)_tR^{17}$ $(Z^{g+})_{1/g}$ where t is an integer ranging from 1 to 6, $R^{17}$ is selected from $SO_3^-$, $OSO_3^-$, $CO_2^-$, and $OCO_2^-$, g is an integer having a value of at least one, $(Z^{g+})_{1/g}$ is a charge-balancing compatible cation and further provided that $R^2$ can not be $(CH_2)_tR^{17}$ $(Z^{g+})_{1/g}$ if $R^1$ contains a quaternary nitrogen, (e)

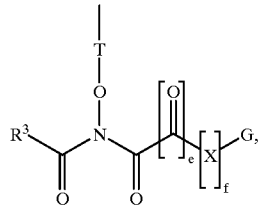

where T is a spacer group selected from the group consisting of $C_2$–$C_{16}$ linear or branched, substituted or unsubstituted alkyl, $C_2$–$C_{16}$ linear or branched, substituted or unsubstituted alkaryl, $C_2$–$C_{16}$ linear or branched, substituted or unsubstituted aralkyl, $C_2$–$C_{16}$ linear or branched, substituted or unsubstituted aryl, and

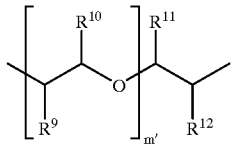

wherein m" is an integer ranging from 1 to 10 and each of $R^9$, $R^{10}$, $R^{11}$, and $R^{12}$ are independently selected from H and $CH_3$ and G is $R^1$ or $R^3$ as defined herein; and (iii) $R^3$ is selected from $C_1$–$C_{12}$ linear or branched chain, saturated or unsaturated alkyl, $C_1$–$C_{12}$ linear or branched chain, saturated or unsaturated alkaryl, $C_1$–$C_{12}$ linear or branched chain, saturated or unsaturated aralkyl, $C_1$–$C_{12}$ linear or branched chain, saturated or unsaturated aryl group and wherein when e and f are 0, $R^3$ is selected from $C_2$–$C_{12}$ linear or branched chain, saturated or unsaturated alkyl, $C_2$–$C_{12}$ linear or branched chain, saturated or unsaturated alkaryl, $C_2$–$C_{12}$ linear or branched chain, saturated or unsaturated aralkyl, and $C_2$–$C_{12}$ linear or branched chain, saturated or unsaturated aryl group.

2. A bleach activator as claimed in claim 1 wherein $R_1$ is a $C_7$–$C_{13}$ linear or branched chain, saturated or unsaturated alkyl group, $R_2$ is a $C_1$–$C_{10}$ linear or branched chain, saturated or unsaturated alkyl group and $R_3$ is a $C_1$–$C_4$ linear or branched chain, saturated or unsaturated alkyl group.

3. The bleach activator compound as claimed in claim 2 wherein $R_2$ is a $C_1$ to $C_4$ linear saturated alkyl group.

4. The bleach activator compound as claimed in claim 2 wherein $R_1$ is a $C_7$–$C_{11}$ linear or branched saturated alkyl group.

5. The bleach activator as claimed in claim 4 wherein $R_2$ and $R_3$ are $CH_3$.

6. The bleach activator compound as claimed in claim 5 wherein $R_1$ is a linear $C_8$ or $C_9$ saturated alkyl group and $R_2$ and $R_3$ are $CH_3$.

7. The bleach activator compound as claimed in claim 1 wherein the sum of the number of carbon atoms in $R_1$, $R_2$ and $R_3$ is less than 19.

8. A bleaching composition comprising:

A) from about 0.1% to about 90% by weight of the composition of an unsymmetrical imide bleach activator having the formula:

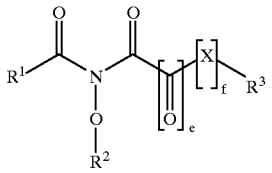

wherein X is selected from O, $NR^{16}$ and S; e is 1; f is 1; $R^{16}$ is selected from H and $C_1$–$C_4$ linear or branched, saturated or unsaturated alkyl groups; and (i) $R^1$ may be selected from the group consisting of (a) phenyl, $C_7$–$C_{13}$ linear or branched chain, saturated or unsaturated alkyl, $C_7$–$C_{13}$ linear or branched chain, saturated or unsaturated alkaryl; $C_7$–$C_{13}$ linear or branched chain, saturated or unsaturated aralkyl, (b) a moiety having the formula:

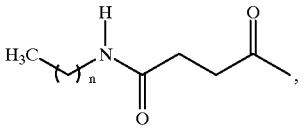

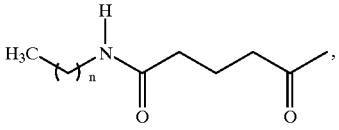

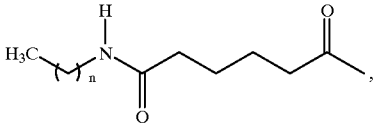

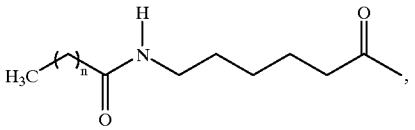

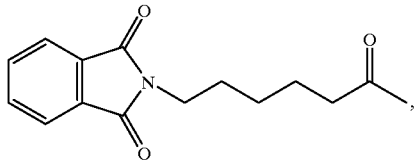

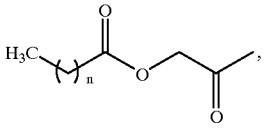

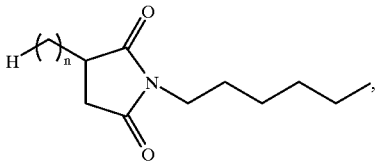

, wherein n is an integer from about 0 to about 12, and (c) a moiety having the formula:

$$(Y^{a-})_{1/a}Q—E—$$

wherein Q has the formula $R^{13}R^{14}R^{15}N^+$ and any of $R^{13}$, $R^{14}$ and $R^{15}$ is independently selected from the group consisting of substituted or unsubstituted alkyl, substituted or unsubstituted alkaryl and substituted or unsubstituted aryl; E is a substituted or unsubstituted polyalkylene, substituted or unsubstituted arylalkylene, substituted or unsubstituted arylpolyalkylene, substituted or unsubstituted polyalkylenearylalkylene or substituted or unsubstituted polyalkylenearylpolyalkylene; a is 1 or higher; $(Y^{a-})_{1/a}$ is a charge-balancing compatible anion;

(ii) $R^2$ is selected from the group consisting of (a) $C_1$–$C_{10}$ branched or unbranched, saturated or unsaturated alkyl, $C_1$–$C_{10}$ branched or unbranched, saturated or unsaturated alkaryl, $C_1$–$C_{10}$ branched or unbranched, saturated or unsaturated aralkyl, and phenyl, (b) $(CH_2)k'CO_2R^8$, where $R^8$ is defined as in (ii)(a) and k' is an integer ranging from about 1 to about 5, (c) $(CH_2)_kN^+R^4R^{51295}$ $R^6$ $(Y^{a-})_{1/a}$, where k is an integer ranging from about 2 to about 6, $R^4$ and $R^5$ are independently selected from the group consisting of substituted or unsubstituted alkyl, substituted or unsubstituted alkaryl and substituted or unsubstituted aryl; $R^6$ is independently selected from H, $R^4$, $—O^-$, $(CH_2)_qSO_3^-$, $(CH_2)_qCO_2^-$ where q is an integer ranging from about 1 to about 5, and $CH_2CHR^7OSO_3^-$ where $R^7$ is a $C_1$–$C_{10}$ branched or unbranched, saturated or unsaturated alkyl, a is an integer having a value of at least one, $(Y^{a-})_{1/a}$ is a charge-balancing compatible anion and further provided that $R^1$ and $R^2$ can not both contain a quaternary nitrogen atom, (d) $(CH_2)_tR^{17}$ $(Z^{g+})_{1/g}$ where t is an integer ranging from about 1 to about 6, $R^{17}$ is selected from $SO_3^-$, $OSO_3^-$, $CO_2^-$, and $OCO_2^-$, g is an integra having a value of at least one, $(Z^{g+})_{1/g}$ is a charge-balancing compatible cation and further provided that $R^2$ can not be $(CH_2)_tR^{17}$ $(Z^{g+})_{1/g}$ if $R^1$ contains a quaternary nitrogen, (e)

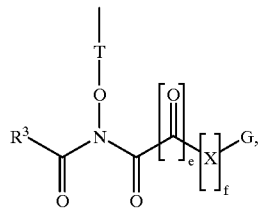

where T is a spacer group selected from the group consisting of $C_2$–$C_{16}$ linear or branched, substituted or unsubstituted alkyl, $C_2$–$C_{16}$ linear or branched, substituted or unsubstituted alkaryl, $C_2$–$C_{16}$ linear or branched, substituted or unsubstituted aralkyl, $C_2$–$C_{16}$ linear or branched, substituted or unsubstituted aryl, and

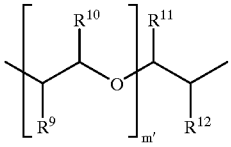

wherein m" is an integer ranging from about 1 to about 10 and each of $R^9$, $R^{10}$, $R^{11}$, and $R^{12}$ are independently selected from H and $CH_3$ and G is $R^1$ or $R^3$ as defined herein; and (iii) $R^3$ is selected from $C_1$–$C_{12}$ linear or branched chain, saturated or unsaturated alkyl, $C_1$–$C_{12}$ linear or branched chain, saturated or unsaturated alkaryl, $C_1$–$C_{12}$ linear or branched chain, saturated or unsaturated aralkyl, $C_1$–$C_{12}$ linear or branched chain, saturated or unsaturated aryl group; and B) from about 0.1% to about 70% of a source of hydrogen peroxide.

9. The composition as claimed in claim 8 wherein $R_1$ is a $C_7$–$C_{13}$ linear or branched chain, saturated or unsaturated alkyl group, $R_2$ is a $C_1$–$C_{10}$ linear or branched chain, saturated or unsaturated alkyl group and $R_3$ is a $C_1$–$C_4$ linear or branched chain, saturated or unsaturated alkyl group.

10. The composition as claimed in claim 9 wherein $R_2$ is a $C_1$ to $C_4$ linear saturated alkyl group.

11. The composition as claimed in claim 9 wherein $R_1$ is a $C_7$–$C_{11}$ linear or branched saturated alkyl group.

12. The composition as claimed in claim 11 wherein $R_2$ and $R_3$ are $CH_3$.

13. The composition as claimed in claim 12 wherein $R_1$ is a linear $C_8$ or $C_9$ saturated alkyl group and $R_2$ and $R_3$ are $CH_3$.

14. The composition as claimed in claim 8 wherein the sum of the number of carbon atoms in $R_1$, $R_2$ and $R_3$ is less than 19.

15. The composition as claimed in claim 8 wherein said composition further comprises from about 0.1% to about 10% by weight of the composition of a surfactant selected from the group consisting of nonionic surfactants, cationic surfactants, anionic surfactants, zwitterionic surfactants, amphoteric surfactants and mixtures thereof.

16. The composition as claimed in claim 8 wherein said composition further includes an ingredient selected from the group consisting of chelating agents, polymeric soil release agents, bleach catalysts, enzymes, builders and mixtures thereof.

17. The composition as claimed in claim 16 wherein said source of hydrogen peroxide is selected from the group consisting of perborate, percarbonate, hydrogen peroxide and mixtures thereof.

18. A method for bleaching soiled fabrics comprising the steps of contacting soiled fabrics to be bleached with an aqueous bleaching liquor, said bleaching liquor including an effective amount of the bleaching composition according to claim 8.

* * * * *